US008827169B2

(12) United States Patent
Narikawa

(10) Patent No.: US 8,827,169 B2
(45) Date of Patent: Sep. 9, 2014

(54) HUMIDITY CONTROL APPARATUS

(75) Inventor: Yoshinori Narikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1042 days.

(21) Appl. No.: 12/675,635

(22) PCT Filed: Aug. 18, 2008

(86) PCT No.: PCT/JP2008/002227

§ 371 (c)(1),
(2), (4) Date: Feb. 26, 2010

(87) PCT Pub. No.: WO2009/028148

PCT Pub. Date: Mar. 5, 2009

(65) Prior Publication Data

US 2011/0057045 A1 Mar. 10, 2011

(30) Foreign Application Priority Data

Aug. 28, 2007 (JP) ..... 2007-221091

(51) Int. Cl.

| | |
|---|---|
| ***F24F 3/14*** | (2006.01) |
| ***F24F 7/00*** | (2006.01) |
| ***B25G 3/18*** | (2006.01) |
| ***F24F 11/00*** | (2006.01) |

(52) U.S. Cl.

CPC ..... *F24F 11/0008* (2013.01); *F24F 3/1429* (2013.01); *F24F 11/0015* (2013.01); *F24F 3/1405* (2013.01); *F24F 3/1411* (2013.01)

USPC ..... 236/44 A; 165/59; 403/322.2

(58) Field of Classification Search

USPC ..... 236/44 A

See application file for complete search history.

(56) References Cited

U.S. PATENT DOCUMENTS

| | | | | | |
|---|---|---|---|---|---|
| 3,512,222 | A * | 5/1970 | Tinnerman | 24/561 |
| 5,692,722 | A * | 12/1997 | Lundagårds | 248/553 |
| 6,241,331 | B1 * | 6/2001 | Kammerl et al. | 312/265.5 |
| 6,253,559 | B1 * | 7/2001 | Kinkel et al. | 62/91 |
| 6,575,228 | B1 * | 6/2003 | Ragland et al. | 165/54 |
| 2003/0116636 | A1 * | 6/2003 | Burkett et al. | 236/44 A |
| 2003/0150593 | A1 * | 8/2003 | Sekhar et al. | 165/4 |
| 2005/0005410 | A1 * | 1/2005 | Biondo et al. | 27/19 |
| 2007/0079619 | A1 * | 4/2007 | Hamada et al. | 62/180 |
| 2007/0144189 | A1 * | 6/2007 | Ishida et al. | 62/157 |
| 2007/0186619 | A1 * | 8/2007 | Butt et al. | 73/29.01 |

FOREIGN PATENT DOCUMENTS

| | | | | |
|---|---|---|---|---|
| JP | 63-99440 A | | 4/1988 | |
| JP | 63099440 | * | 4/1988 | F24F 7/08 |
| JP | 63099440 | * | 4/1998 | |
| JP | 2002-243259 A | | 8/2002 | |
| JP | 2005-291532 A | | 10/2005 | |
| JP | 2007-010229 | * | 1/2007 | |
| JP | 2007-10229 A | | 1/2007 | |
| JP | 2007010229 | * | 1/2007 | |

* cited by examiner

*Primary Examiner* — Alexandra Elve
*Assistant Examiner* — Henry Crenshaw
(74) *Attorney, Agent, or Firm* — Birch, Stewart, Kolasch & Birch, LLP

(57) ABSTRACT

A plurality of humidity control chambers are provided in a casing. An open/close damper is provided for each of a plurality of air flow ports communicating with the humidity control chambers. Adjacent dampers of the plurality of dampers are separably coupled together by a coupling member.

6 Claims, 19 Drawing Sheets

HUMIDITY CONTROL APPARATUS

TECHNICAL FIELD

The present invention relates to humidity control apparatuses for controlling humidity of air, particularly to humidity control apparatuses including a plurality of dampers for opening/closing air flow ports communicating with a plurality of humidity control chambers for controlling the air humidity.

BACKGROUND ART

Humidity control apparatus for controlling humidities of outdoor air and indoor air, and supplying the humidity-controlled air to the inside of a room have been known. Patent Document 1 shows a humidity control apparatus including an adsorption heat exchanger carrying an adsorbent on a surface thereof.

The humidity control apparatus of Patent Document 1 includes a first adsorption heat exchanger placed in a first humidity control chamber, and a second adsorption heat exchanger placed in a second humidity control chamber. The adsorption heat exchangers are connected to a refrigerant circuit. The refrigerant circuit alternately performs operation in which the first adsorption heat exchanger functions as a condenser, and the second adsorption heat exchanger functions as an evaporator, and operation in which the second adsorption heat exchanger functions as a condenser, and the first adsorption heat exchanger functions as an evaporator. In the adsorption heat exchanger functioning as the evaporator, the adsorbent adsorbs moisture in the air. In the adsorption heat exchanger functioning as the condenser, the moisture is released from the adsorbent, and is contained in the air.

The humidity control apparatus of Patent Document 1 supplies one of the flows of air that passed through the adsorption heat exchangers, and discharges the other flow. For example, in the humidity control apparatus in dehumidifying operation, an air flow passage in the casing is determined in such a manner that the air that passed through one of the first and second adsorption heat exchangers functioning as the evaporator is supplied to the inside of the room, and the air that passed through the other adsorption heat exchanger functioning as the condenser is discharged outside the room.

In the humidity control apparatus of Patent Document 1, the air flow passage is switched by opening/closing a plurality of dampers. Specifically, in this humidity control apparatus, opening/closing of eight dampers is controlled to change the passage of the air flowing through the adsorption heat exchangers, thereby switching dehumidifying operation, humidifying operation, etc.

However, the provision of the plurality of dampers involves difficult maintenance of the dampers. Specifically, when the dampers are independently arranged, attachment and detachment of the dampers are complicated, thereby reducing efficiency of the maintenance.

As a solution to this problem, in the humidity control apparatus of Patent Document 1, two adjacent dampers are combined as an integrated unit (a damper unit) which is able to be drawn out of the casing. This allows for attachment/detachment of the two dampers to/from the casing together, thereby improving the efficiency of the maintenance.

Patent Document

PATENT DOCUMENT 1: Japanese Patent Publication No. 2005-291532

SUMMARY OF THE INVENTION

Technical Problem

If the adjacent dampers are combined as an integrated damper unit as taught by Patent Document 1, sufficient space for the maintenance of the damper unit (space required for attachment/detachment of the dampers) cannot be ensured. Specifically, the above-described damper unit includes two dampers. Therefore, in drawing the damper unit out, space allowing for drawing both dampers out of the casing is required. For example, if the two dampers are aligned in the longitudinal direction thereof, and the damper unit is drawn in the alignment direction, at least a length greater than the sum of the lengths of the two dampers is required to draw the damper unit out. Thus, with a plurality of dampers combined as an integrated damper unit, sufficient space is required around the humidity control apparatus to ensure the space for the maintenance of the dampers, thereby limiting the installation location of the humidity control apparatus.

In view of the foregoing, the present invention has been achieved. The invention is directed to provide a humidity control apparatus which allows for easy detachment/attachment of a plurality of dampers in minimum maintenance space.

Solution to the Problem

A first aspect of the invention is directed to a humidity control apparatus including: a casing (11) in which air enters; a plurality of humidity control chambers (37, 38) provided in the casing (11), and containing humidity controllers (51, 52) for controlling humidity of the air, respectively; and a plurality of dampers (41-48) for opening/closing a plurality of air flow ports (41*a*-48*a*) communicating with the humidity control chambers (37, 38), and allowing the air to enter or exit the humidity control chambers (37, 38), wherein adjacent dampers of the plurality of dampers (41-48) constitute an integrated damper unit (100) which can be drawn out of the casing (11), and the damper unit (100) includes a coupling mechanism (152, 162) for separably coupling the adjacent dampers (41-48) together.

According to the humidity control apparatus of the first aspect of the invention, a plurality of humidity control chambers (37, 38) are provided in the casing (11). Each of the humidity control chambers (37, 38) contains the humidity controller (51, 52) for controlling humidity of the air. The air that entered the casing (11) passes through the air flow ports (41*a*-48*a*) communicating with the humidity control chambers (37, 38), experiences humidity control by the humidity controller (51, 52), and is supplied to the inside of the room, etc. The dampers (41-48) are provided at the air flow ports (41*a*-48*a*), respectively. An air flow passage is switched by opening/closing the dampers (41-48).

Adjacent dampers (41-48) of the plurality of dampers (41-48) are coupled together by the coupling mechanism (152, 162) into a single unit (a damper unit). Drawing the damper unit (100) out of the casing (11) makes it possible to take the plurality of dampers (41-48) together out of the casing.

The coupling mechanism (152, 162) is able to separate the plurality of dampers (41-48). Therefore, while drawing the damper unit (100) out, the dampers (41-48) can be separated and divided. This makes it possible to remove the dampers (41-48) from the casing (11) one by one using only a space for drawing out a single damper (41-48). When placing the dampers (41-48) inside the casing (11), the separated dampers (41-48) are coupled together by the coupling mechanism (152, 162) one by one, and are returned to the original position as the damper unit (100).

In a second aspect of the invention related to the humidity control apparatus of the first aspect of the invention, the casing (11) includes a rail (141-144) extending in a direction of drawing the damper unit (100) to guide the damper unit (100).

According to the second aspect of the invention, the rail (141-144) is provided in the casing (11). The rail (141-144) is able to guide the damper unit (100) in the drawing direction. Therefore, a worker, etc., can easily detach or attach the damper unit (100) by sliding the damper unit (100) along the rail (141-144).

In a third aspect of the invention related to the humidity control apparatus of the first or second aspect of the invention, the coupling mechanism includes a pair of engagement sections (152, 162) provided on coupling ends of the adjacent dampers (41-48), respectively, to be able to engage with each other to couple the dampers (41-48), and the pair of engagement sections (152, 162) are prevented from disengaging in the drawing direction of the damper unit (100), but are allowed to disengage in a direction different from the drawing direction.

According to the third aspect of the invention, a pair of engagement sections (152, 162) as the coupling mechanism are provided on the coupling ends of the adjacent dampers (41-48), respectively. The engagement sections (152, 162) are prevented from disengaging in the drawing direction of the damper unit (100). Therefore, in drawing the damper unit (100) out of the casing (11), the dampers (41-48) are kept coupled by the engagement sections (152, 162), and the dampers (41-48) can be drawn out together. The engagement sections (152, 162) are allowed to disengage in the direction different from the drawing direction.

Therefore, in drawing the damper unit (100) out, one of the dampers (41-48) is moved in the different direction, thereby disengaging the pair of engagement sections (152, 162). As a result, one of the dampers (41-48) is separated from the damper unit (100).

In a fourth aspect of the invention related to the humidity control apparatus of the first or second aspect of the invention, the coupling mechanism includes a flat protrusion (152) provided on a coupling end of one of the adjacent dampers (41-48) to protrude orthogonally to the drawing direction, and a flat hook (162) provided on a coupling end of the other damper (41-48), and is bent to cover a tip end of the flat protrusion (152).

According to the fourth aspect of the invention, the flat protrusion (152) is provided on the coupling end of one of the adjacent dampers (41-48), and the flat hook (162) is provided on the coupling end of the other damper. The flat protrusion (152) protrudes orthogonally to the drawing direction of the damper unit (100). The flat hook (162) is bent to cover the tip end of the flat protrusion (152). With this configuration, in drawing the damper unit (100) out, the flat hook (162) is caught on the flat protrusion (152), thereby coupling the dampers (41-48). This makes it possible to draw the dampers (41-48) together.

While drawing the damper unit (100) out, the flat hook (162) is allowed to slide orthogonally to the drawing direction relative to the flat protrusion (152), thereby detaching the flat hook (162) from the flat protrusion (152). Thus, the dampers (41-48) are easily disengaged, and separated.

In a fifth aspect of the invention related to the humidity control apparatus of any one of the first to fourth aspects of the invention, the casing (11) includes a divider plate (71, 72) in which the plurality of air flow ports (41*a*-48*a*) communicating with the humidity control chambers (37, 38) are formed, and the damper unit (100) is placed in the casing (11) in such a manner that a gap formed between coupling ends of the adjacent dampers (41-48) faces the divider plate (71, 72).

According to the fifth aspect of the invention, the divider plate (71, 72) is provided in the casing (11). The plurality of air flow ports (41*a*-48*a*) corresponding to the humidity chambers (37, 38) are formed in the divider plate (71, 72). With the damper unit (100) placed in the casing (11), the gap formed between the coupling ends of the dampers (41-48) faces the divider plate (71, 72). This can prevent communication between the inside and the outside of each of the humidity control chambers (37, 38) through the gap formed between the dampers (41-48), thereby preventing leakage of the air through the gap.

In a sixth aspect of the invention related to the humidity control apparatus of any one of first to fifth aspects of the invention, the damper unit (100) is able to be drawn out in a direction of alignment of the adjacent dampers (41-48).

According to the sixth aspect of the invention, the damper unit (100) is drawn out in the direction of alignment of the adjacent dampers (41-48). For drawing a conventional damper unit out of the casing in the alignment direction of the dampers, space for drawing out the damper unit requires a length larger than the sum of dimensions of the dampers in the alignment direction (e.g., a longitudinal dimension). Thus, the conventional damper unit requires relatively large space around the casing.

In the present invention, however, the dampers (41-48) can suitably be separated from the damper unit (100). Therefore, the length of the space for drawing out (or attaching) the dampers can be reduced as much as possible.

In a seventh aspect of the invention related to the humidity control apparatus of the sixth aspect of the invention, the casing (11) contains multiple ones of the damper unit (100) arranged in such a manner that the dampers (41-48) are aligned in the same direction.

According to the seventh aspect of the invention, multiple ones of the damper unit (100) are arranged in the casing (11). Each of the damper units (100) is drawn out in the same direction, i.e., in the alignment direction of the dampers (41-48). Therefore, a worker, etc., can draw every damper unit (100) out from the same side of the casing (11).

In an eighth aspect of the invention related to the humidity control apparatus of any one of the first to seventh aspects of the invention, the damper unit (100) includes a sealing member (170) for filling the gap formed between the coupling ends of the adjacent dampers (41-48).

According to the eighth aspect of the invention, the sealing member (170) is provided in the gap formed between the coupling ends of the adjacent dampers (41-48). Thus, the sealing member (170) can prevent the communication between the inside and the outside of each of the humidity control chambers (37, 38) through the gap between the dampers (41-48), thereby preventing leakage of the air through the gap.

Advantages of the Invention

According to the present invention, the coupling member (152, 162) for separably coupling the adjacent dampers (41-48) together is provided. Thus, the invention makes it possible to draw out or attach the plurality of dampers (41-48) coupled by the coupling member (152, 162) together. Therefore, for example, in comparison with the case where the dampers are detached/attached one by one, maintenance of the dampers (41-48) can be performed with improved efficiency. In the present invention, the dampers (41-48) are separated while drawing the damper unit (100) out, thereby reducing space required to draw the dampers (41-48) out. Further, the damper unit (100) can be placed in the casing while coupling the dampers (41-48), thereby reducing space required for the attachment of the dampers (41-48). Therefore, limitation on the installation location of the humidity control apparatus is alleviated due to the reduction of the space for the maintenance of the plurality of dampers (41-48).

According to the second aspect of the invention, the rail (141-144) for guiding the dampers (41-48) is provided. This makes the detachment/attachment of the dampers (41-48) easier, thereby improving efficiency of the maintenance.

According to the third aspect of the invention, the engagement sections (152, 162) are arranged on the coupling ends of the adjacent dampers (41-48), and the engagement sections (152, 162) are prevented from disengaging in the drawing direction. Therefore, according to the invention, disengagement of the dampers (41-48) at the start of the drawing of the damper unit (100) can be avoided, thereby allowing for reliably drawing the dampers (41-48) out together.

According to the fourth aspect of the invention, the flat protrusion (152) is arranged on the coupling end of one of the adjacent dampers (41-48), and the flat hook (162) is arranged on the coupling end of the other damper. Thus, the invention makes it possible to reliably draw the dampers (41-48) out together by hooking the flat hook (162) on the flat protrusion (152) in drawing the damper unit (100) out. The flat protrusion (152) can easily be detached from the flat hook (162) by moving the flat hook (162) orthogonally to the drawing direction relative to the flat protrusion (152). This allows for easy separation of the dampers (41-48), thereby improving the maintenance efficiency to a further extent.

According to the sixth aspect of the invention, the damper unit (100) is drawn out in the direction of alignment of the dampers (41-48). With the dampers (41-48) configured to be separable, the length of the space required to draw out or attach the dampers (41-48) can effectively be reduced.

In particular, according to the seventh aspect of the invention, the plurality of damper units (100) can be drawn out in the same direction. Therefore, the space for the maintenance of the dampers (41-48) can be concentrated on the same side of the casing (11). This allows for further reduction of the space for maintenance of the dampers (41-48).

According to the fifth and eighth aspects of the invention, leakage of the air through the gap formed between the coupling ends of the dampers (41-48) of the damper unit (100) can reliably be prevented. This can prevent change in humidity of the air due to the air leakage after the humidity control has been done.

DESCRIPTION OF EMBODIMENTS

Figure 1:
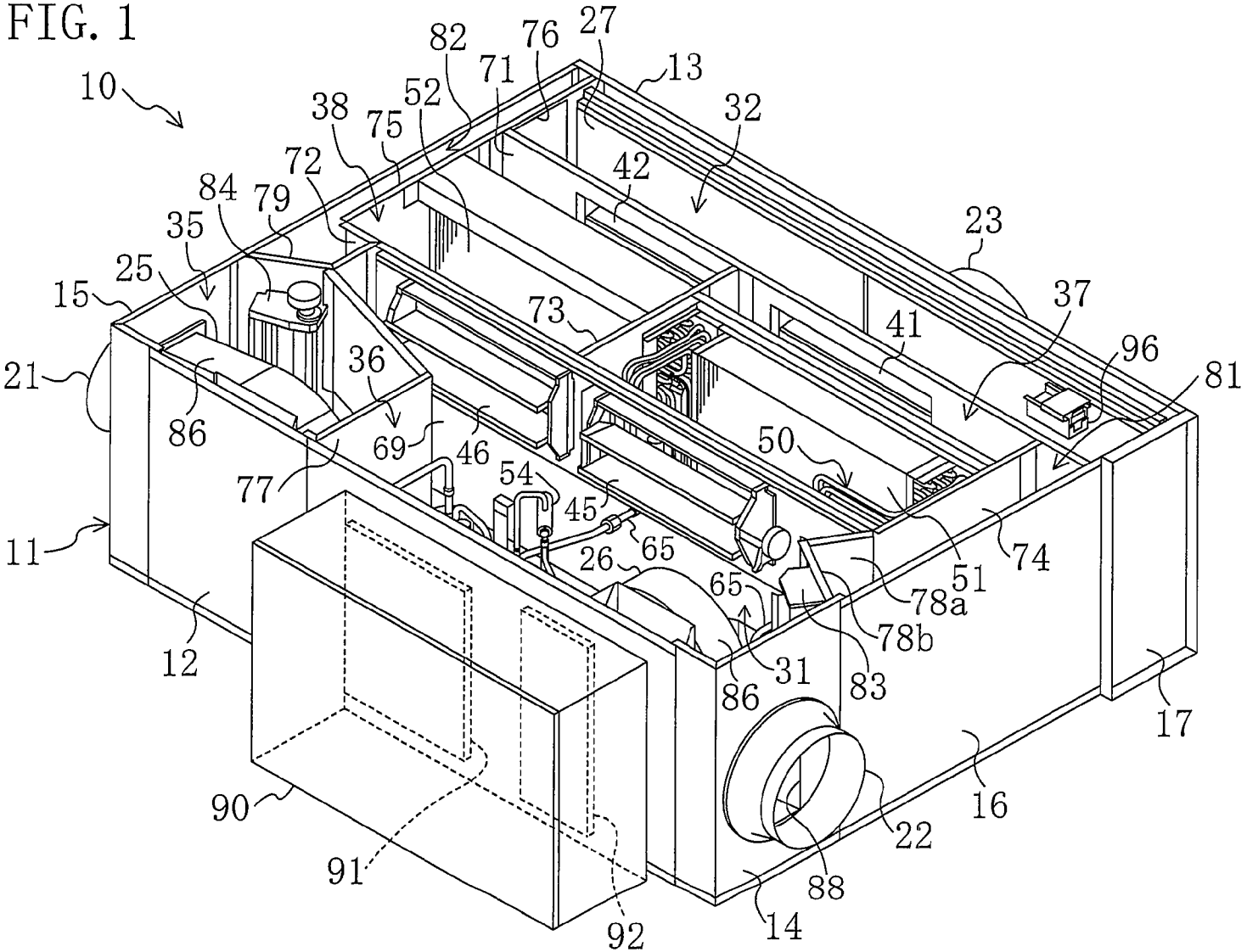
FIG. 1 is a perspective view illustrating a humidity control apparatus viewed from the front with a top plate of a casing not shown.

Embodiments of the present invention will be described in detail with reference to the drawings. A humidity control apparatus (10) of the present embodiment performs humidity control and ventilation of the inside of a room. The humidity control apparatus takes outdoor air (OA) therein for humidity control, and supplies the humidity-controlled air to the inside of the room, and simultaneously, the humidity control apparatus takes room air (RA) therein, and discharges the room air outside the room.

<General Structure of Humidity Control Apparatus>

The humidity control apparatus (10) will be described with reference to FIGS. 1 to 5. The terms "upper," "lower," "left," "right," "front," "back," "frontward," and "backward" used in the following description indicate the directions relative to the humidity control apparatus (10) as seen from the front, unless otherwise specified.

The humidity control apparatus (10) includes a casing (11). A refrigerant circuit (50) is provided in the casing (11). The refrigerant circuit (50) contains a first adsorption heat exchanger (51), a second adsorption heat exchanger (52), a compressor (53), a four-way switching valve (54), and a motor-operated expansion valve (55). Details of the refrigerant circuit (50) will be described below.

The casing (11) is in the shape of a flat, relatively short rectangular parallelepiped. The casing (11) has a dimension in the lateral direction larger than a dimension in the fore-and-aft direction (see FIG. 3). In the casing (11), a left front plane in FIG. 1 (i.e., a front plane) constitutes a front panel (12), and a right back plane in FIG. 1 (i.e., a back plane) constitutes a back panel (13). Further, a right front plane of the casing (11) in FIG. 1 constitutes a first side panel (14), and a left back plane in FIG. 1 constitutes a second side panel (15).

The casing (11) is configured in such a manner that the front panel (12) and the back panel (13) face each other, and the first side panel (14) and the second side panel (15) face each other. The first side panel (14) and the second side panel (15) of the casing (11) constitute side planes, respectively.

The casing (11) further includes an outdoor air inlet (24), an indoor air inlet (23), a supply port (22), and a discharge port (21).

Figure 3:
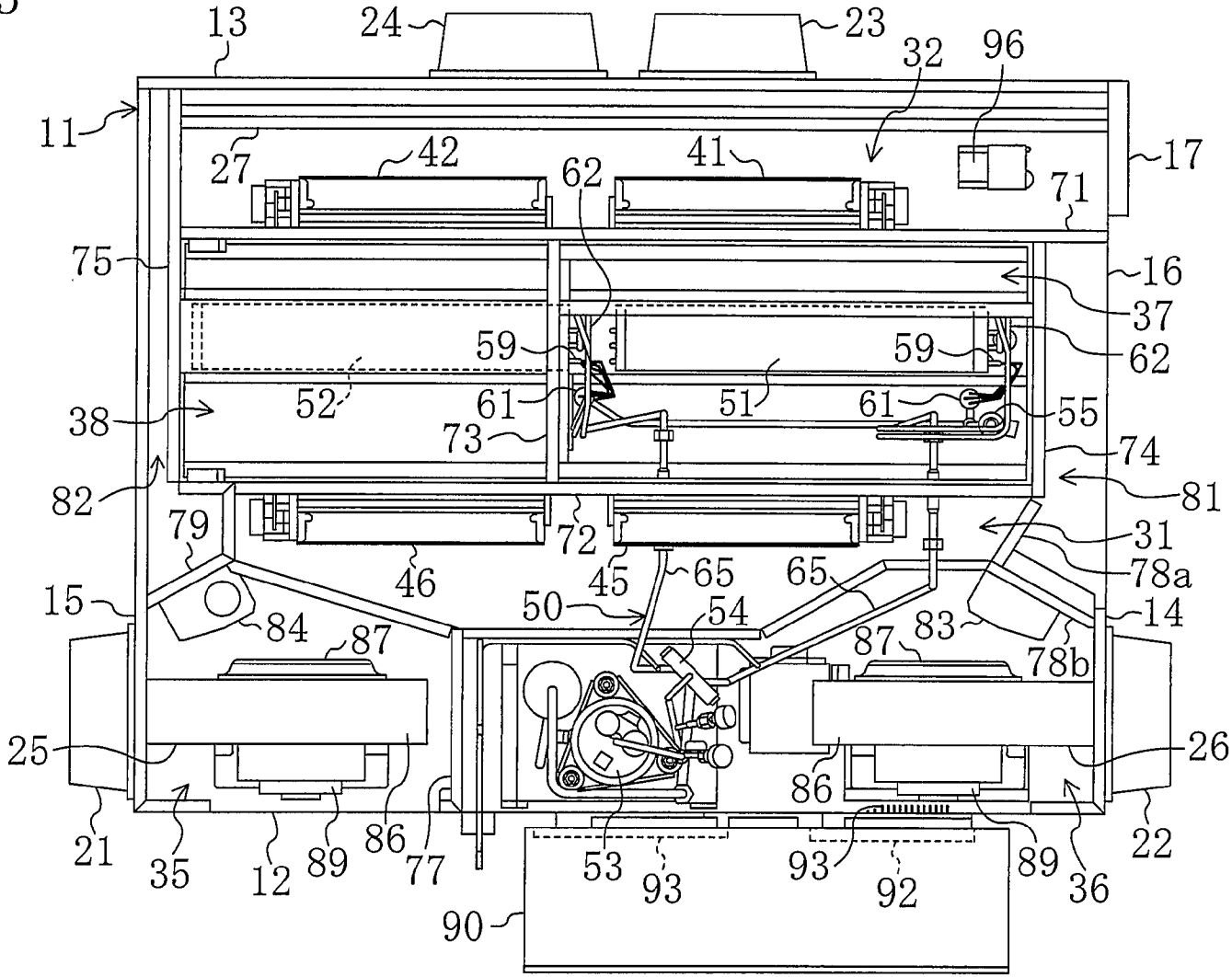
FIG. 3 is a plan view illustrating the humidity control apparatus with the top plate of the casing not shown.
Figure 4:
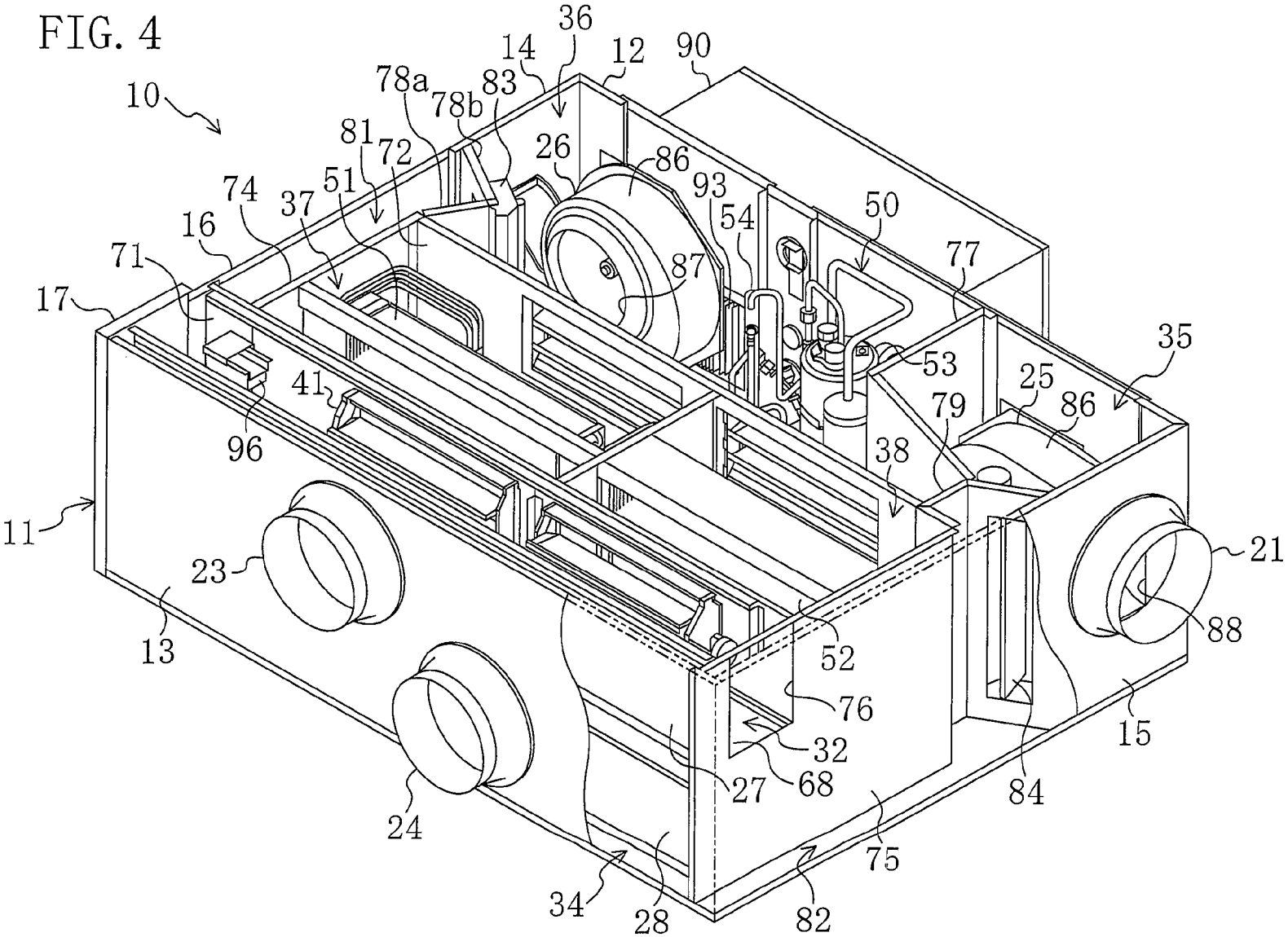
FIG. 4 is a perspective view illustrating the humidity control apparatus viewed from the back with the top plate of the casing not shown.

The outdoor air inlet (24) and the indoor air inlet (23) are opened in the back panel (13) (see FIGS. 3 and 4). The outdoor air inlet (24) is formed in a lower portion of the back panel (13), and is shifted from the lateral center of the back panel (13) toward the second side panel (15). The indoor air inlet (23) is formed in an upper portion of the back panel (13), and is shifted from the lateral center of the back panel (13) toward the first side panel (14).

The supply port (22) is arranged near an edge of the first side panel (14) close to the front panel (12). The discharge port (21) is arranged near an edge of the second side panel (15) close to the front panel (12).

The casing (11) contains an upstream divider plate (71), a downstream divider plate (72), a central divider plate (73), a first divider plate (74), and a second divider plate (75). Each of the divider plates (71-75) is vertically arranged on a bottom plate of the casing (11), and divides space inside the casing (11) from the bottom plate to the top plate of the casing (11).

The upstream divider plate (71) and the downstream divider plate (72) are arranged parallel to the front panel (12) and the back panel (13). In the space inside the casing (11), the upstream divider plate (71) is arranged close to the back panel (13), and the downstream divider plate (72) is arranged close to the front panel (12).

A lateral dimension of the upstream divider plate (71) is smaller than a lateral dimension of the casing (11). A right end of the upstream divider plate (71) is joined to the first side panel (14). A gap is formed between a left end of the upstream divider plate (71) and the second side panel (15).

A lateral dimension of the downstream divider plate (72) is smaller than a lateral dimension of the upstream divider plate (71). A gap is formed between a right end of the downstream divider plate (72) and the first side panel (14). A gap is formed between a left end of the downstream divider plate (72) and the second side panel (15).

The first divider plate (74) is arranged to close the space between the upstream divider plate (71) and the downstream divider plate (72) from the right. Specifically, the first divider plate (74) is arranged parallel to the first side panel (14), and orthogonally to the upstream divider plate (71) and the downstream divider plate (72). A front end of the first divider plate (74) is joined to the right end of the downstream divider plate (72). A back end of the first divider plate (74) is joined to the upstream divider plate (71).

The second divider plate (75) is arranged to close the space between the upstream divider plate (71) and the downstream divider plate (72) from the left. Specifically, the second divider plate (75) is arranged parallel to the second side panel (15), and orthogonally to the upstream divider plate (71) and the downstream divider plate (72). A front end of the second divider plate (75) is joined to a left end of the downstream divider plate (72). A back end of the second divider plate (75) is joined to the back panel (13). The left end of the upstream divider plate (71) is joined to the second divider plate (75).

The central divider plate (73) is arranged between the upstream divider plate (71) and the downstream divider plate (72) to be orthogonal to the upstream divider plate (71) and the downstream divider plate (72). The central divider plate (73) extends from the upstream divider plate (71) to the downstream divider plate (72), and divides the space between the upstream divider plate (71) and the downstream divider plate (72) into a right room and a left room. The central divider plate (73) is slightly shifted from the lateral center of the upstream divider plate (71) and the downstream divider plate (72) toward the second side panel (15).

Figure 2:
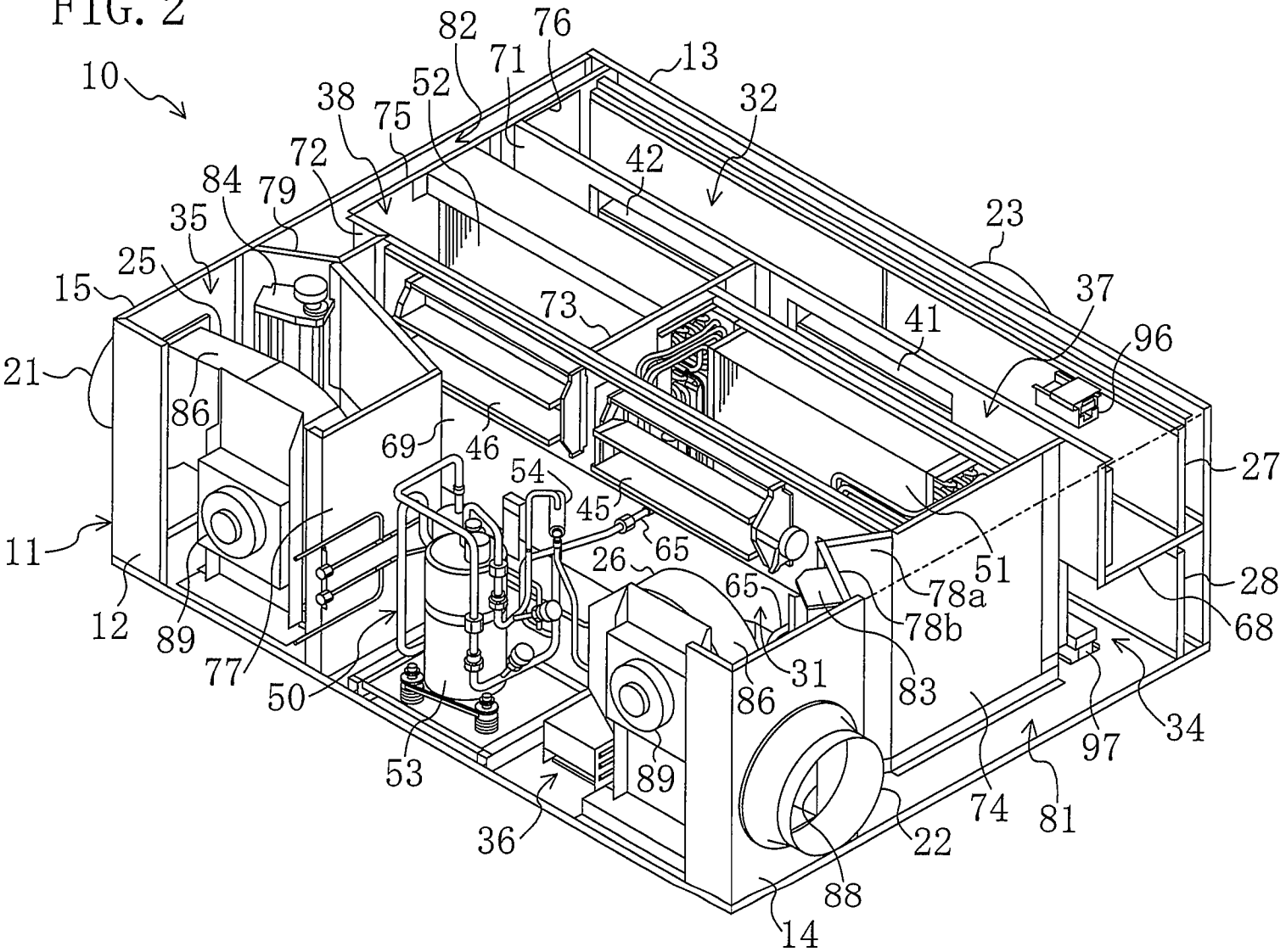
FIG. 2 is a perspective view illustrating the humidity control apparatus viewed from the front with part of the casing and an electrical component box not shown.
Figure 5:
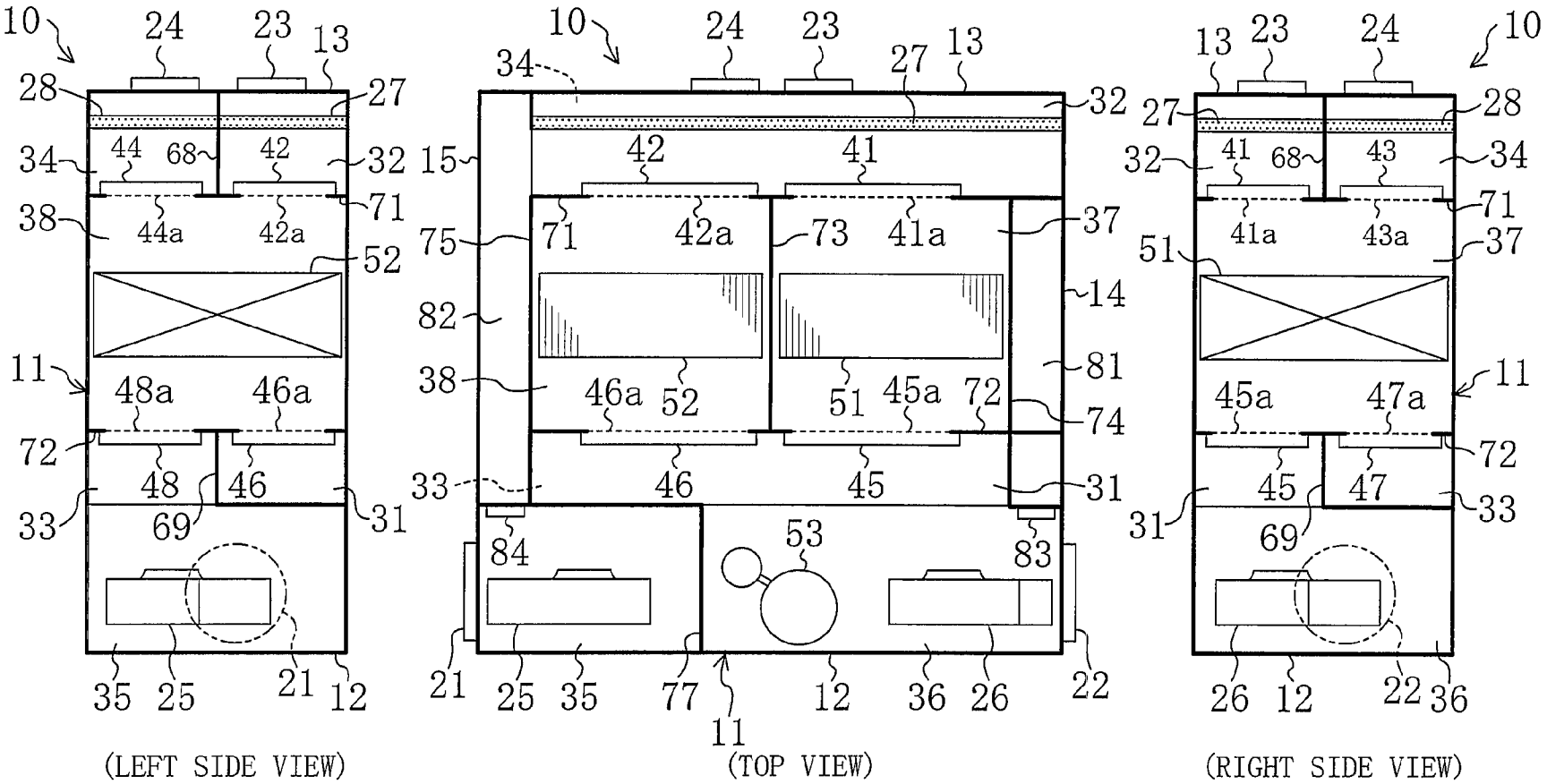
FIG. 5 schematically shows a plan view, a right side view, and a left side view of the humidity control apparatus, partially omitted.

Space between the upstream divider plate (71) and the back panel (13) in the casing (11) is horizontally divided into two rooms by a first horizontal divider plate (68) (see FIGS. 2, 4, and 5). An upper room constitutes a room air passage (32), and a lower room constitutes an outdoor air passage (34).

The room air passage (32) communicates with the inside of the room through a duct connected to the indoor air inlet (23). The room air passage (32) includes a room air filter (27) for removing dust, etc. from the air. The room air filter (27) is in the shape of a rectangular plate with a long side thereof extending in the lateral direction, and is vertically arranged to extend across the room air passage (32). The room air filter (27) divides the room air passage (32) into two rooms aligned in the fore-and-aft direction. A room air humidity sensor (96) is arranged in the room air passage (32) in front of (downstream of) the room air filter (27). The room air humidity sensor (96) is attached to the top plate of the casing (11), and measures relative humidity in the air.

The outdoor air passage (34) communicates with the outside of the room through a duct connected to the outdoor air inlet (24). The outdoor air passage (34) includes an outdoor air filter (28) for removing dust, etc., from the air. The outdoor air filter (28) is in the shape of a rectangular plate with a long side thereof extending in the lateral direction, and is vertically arranged to extend across the outdoor air passage (34). The outdoor air filter (28) divides the outdoor air passage (34) into two rooms aligned in the fore-and-aft direction. An outdoor air humidity sensor (97) is arranged in the outdoor air passage (34) in front of (downstream of) the outdoor air filter (28). The outdoor air humidity sensor (97) is attached to the bottom plate of the casing (11), and measures relative humidity of the air.

As described above, the space between the upstream divider plate (71) and the downstream divider plate (72) in the casing (11) is vertically divided into two rooms by the central divider plate (73). The room on the right of the central divider plate (73) constitutes a first heat exchange chamber (37), and the room on the left of the central divider plate (73) constitutes a second heat exchange chamber (38) (see FIGS. 1 and 3). Each of the first and second heat exchange chambers (37, 38) constitutes a humidity control chamber of the present invention.

The first heat exchange chamber (37) contains the first adsorption heat exchanger (51). The second heat exchange chamber (38) contains the second adsorption heat exchanger (52). Each of the adsorption heat exchangers (51, 52) is in the shape of a thick rectangular plate, or a flat rectangular parallelepiped, and constitutes a humidity controller for controlling humidity of the air. Details of the adsorption heat exchangers (51, 52) will be described later.

Each of the adsorption heat exchangers (51, 52) is vertically arranged in the corresponding heat exchange chamber (37, 38) with the front and back surfaces thereof parallel to the upstream divider plate (71) and the downstream divider plate (72). Specifically, the adsorption heat exchangers (51, 52) are arranged to extend across the heat exchange chambers (37, 38). Each of the adsorption heat exchangers (51, 52) divides the corresponding heat exchange chamber (37, 38) into two rooms aligned in the fore-and-aft direction. In each of the heat exchange chambers (37, 38), the adsorption heat exchanger (51, 52) is arranged closer to the upstream divider plate (71) than to the fore-and-aft center of the heat exchange chamber (37, 38). The adsorption heat exchangers (51, 52) are substantially aligned with each other in the lateral direction.

Each of the adsorption heat exchangers (51, 52) includes a liquid separator (61), and a gas header (62). Every part of the first adsorption heat exchanger (51) including the liquid separator (61) and the gas header (62) is contained in the first heat exchange chamber (37). On the other hand, almost every part of the second adsorption heat exchanger (52) including fins (57) is contained in the second heat exchange chamber (38), but a part of which penetrates the central divider plate (73), and is exposed in the first heat exchange chamber (37). Specifically, the liquid separator (61) and the gas header (62) of the second adsorption heat exchanger (52) are arranged in the first heat exchange chamber (37). Further, a U-shaped tube (59) arranged at an end of the second adsorption heat exchanger (52) at which the liquid separator (61) and the gas header (62) are connected is also exposed in the first heat exchange chamber (37). The first heat exchange chamber (37) further contains the motor-operated expansion valve (55) of the refrigerant circuit (50).

In the casing (11), space extending along the front surface of the downstream divider plate (72) is horizontally divided into two rooms (see FIGS. 2 and 5). An upper room constitutes a supply air passage (31), and a lower room constitutes a discharge air passage (33).

The upstream divider plate (71) is provided with first to fourth air flow ports (41*a*, 42*a*, 43*a*, 44*a*) (see FIG. 5). Each of the air flow ports (41*a*-44*a*) is substantially in the shape of a horizontally oriented rectangle. Specifically, the first air flow port (41*a*) is formed in a portion (an upper portion) of the upstream divider plate (71) facing the room air passage (32) on the right of the central divider plate (73), and the second air flow port (42*a*) is formed in the upper portion on the left of the central divider plate (73). The third air flow port (43*a*) is formed in a portion (a lower portion) of the upstream divider plate (71) facing the outdoor air passage (34) on the right of the central divider plate (73), and the fourth air flow port (44*a*) is fanned in the lower portion on the left of the central divider plate (73).

The first air flow port (41*a*) allows the room air passage (32) to communicate with the first heat exchange chamber (37), and the second air flow port (42*a*) allows the room air passage (32) to communicate with the second heat exchange chamber (38). The third air flow port (43*a*) allows the outdoor air passage (34) to communicate with the first heat exchange chamber (37), and the fourth air flow port (44*a*) allows the outdoor air passage (34) to communicate with the second heat exchange chamber (38).

Four open/close dampers (41, 42, 43, 44) are provided on the back surface of the upstream divider plate (71) in the space inside the casing (11). The dampers (41-44) are configured to open and close the first to fourth air flow ports (41*a*-44*a*), respectively. Specifically, a first damper (41) corresponding to the first air flow port (41*a*), a second damper (42) corresponding to the second air flow port (42*a*), a third damper (43) corresponding to the third air flow port (43*a*), and a fourth damper (44) corresponding to the fourth air flow port (44*a*) are provided on the back surface of the upstream divider plate (71).

The downstream divider plate (72) is provided with fifth to eighth air flow ports (45*a*, 46*a*, 47*a*, 48*a*) (see FIG. 5). Each of the air flow ports (45*a*-48*a*) is substantially in the shape of a horizontally oriented rectangle. Specifically, the fifth air flow port (45*a*) is formed in a portion (an upper portion) of the downstream divider plate (72) facing the supply air passage (31) on the right of the central divider plate (73), and the sixth air flow port (46*a*) is formed in the upper portion on the left of the central divider plate (73). The seventh air flow port (47*a*) is formed in a portion (a lower portion) of the downstream divider plate (72) facing the discharge air passage (33) on the right of the central divider plate (73), and the eighth air flow port (48*a*) is formed in the lower portion on the left of the central divider plate (73).

The fifth air flow port (45*a*) allows the supply air passage (31) to communicate with the first heat exchange chamber (37), and the sixth air flow port (46*a*) allows the supply air passage (31) to communicate with the second heat exchange chamber (38). The seventh air flow port (47*a*) allows the discharge air passage (33) to communicate with the first heat exchange chamber (37), and the eighth air flow port (48*a*) allows the discharge air passage (33) to communicate with the second heat exchange chamber (38).

Among the first to eighth dampers (41-48), two adjacent dampers are coupled together as an integrated damper unit (100). The damper unit (100) is able to be drawn out of the casing (11). Details of the damper unit (100) will be described later.

In the casing (11), the space between the supply air passage (31) and the discharge air passage (33), and the front panel (12) is vertically divided into two rooms by a divider plate (77). One of the rooms on the right of the divider plate (77) constitutes a supply fan chamber (36), and the other room on the left of the divider plate (77) constitutes a discharge fan chamber (35). The divider plate (77) stands closer to the second side panel (15) than the central divider plate (73). The supply fan chamber (36) and the discharge fan chamber (35) are rooms extending from the bottom plate to the top plate of the casing (11), respectively.

The supply fan chamber (36) contains a supply fan (26). The discharge fan chamber (35) contains a discharge fan (25). Each of the supply fan (26) and the discharge fan (25) is a multi-blade centrifugal fan (a so-called sirocco fan).

Specifically, each of the fans (25, 26) includes a fan rotor, a fan casing (86), and a fan motor (89). Although not shown, the fan rotor is in the shape of a cylinder having a length in the axial direction shorter than a diameter thereof, and a plurality of blades are arranged on a circumferential surface thereof. The fan rotor is contained in the fan casing (86). The fan casing (86) has an inlet (87) opened in one of side surfaces thereof (a side surface orthogonal to the axial direction of the fan rotor). The fan casing (86) further includes a protrusion protruding from a circumferential surface thereof, and an outlet (88) is opened at the protruding end thereof. The fan motor (89) is attached to one of the side surfaces of the fan casing (86) opposite the inlet (87). The fan motor (89) is connected to the fan rotor to drive the fan rotor to rotate.

In the supply fan (26) and the discharge fan (25), when the fan rotor is driven to rotate by the fan motor (89), the air is sucked into the fan casing (86) through the inlet (87), and the air in the fan casing (86) is blown out through the outlet (88).

In the supply fan chamber (36), the supply fan (26) is arranged in such a manner that the inlet (87) of the fan casing (86) faces the downstream divider plate (72). The outlet (88) of the fan casing (86) of the supply fan (26) is attached to the first side panel (14) to communicate with the supply port (22).

In the discharge fan chamber (35), the discharge fan (25) is arranged in such a manner that the inlet (87) of the fan casing (86) faces the downstream divider plate (72). The outlet (88) of the fan casing (86) of the discharge fan (25) is attached to the second side panel (15) to communicate with the discharge port (21).

The supply fan chamber (36) contains the compressor (53) and the four-way switching valve (54) of the refrigerant circuit (50). The compressor (53) and the four-way switching valve (54) are arranged in the supply fan chamber (36) between the supply fan (26) and the divider plate (77).

Communication pipes (65) extending from the gas headers (62) of the adsorption heat exchangers (51, 52) are connected to the four-way switching valve (54). The communication pipes (65) penetrate the downstream divider plate (72). Specifically, the communication pipes (65) penetrate a portion (an upper portion) of the downstream divider plate (72) facing the supply air passage (31) on the right of the central divider plate (73) (i.e., a portion facing the first heat exchange chamber (37)). One of the liquid separators (61) of the adsorption heat exchangers (51, 52) is connected to an end of the motor-operated expansion valve (55), and the other liquid separator is connected to the other end of the motor-operated expansion valve (55).

In the casing (11), space between the first divider plate (74) and the first side panel (14) constitutes a first bypass passage (81) (see FIGS. 2 and 3). Further, space between the second divider plate (75) and the second side panel (15) in the casing (11) constitutes a second bypass passage (82) (see FIGS. 3 and 4). The first bypass passage (81) and the second bypass passage (82) are rooms extending from the bottom plate to the top plate of the casing (11).

A starting end (an end near the back panel (13)) of the first bypass passage (81) communicates only with the outdoor air passage (34), and is blocked from the room air passage (32). The first bypass passage (81) communicates with a downstream portion of the outdoor air filter (28) in the outdoor air passage (34). At a terminal end (an end near the front panel (12)) of the first bypass passage (81), a first bypass divider plate (78*a*) and a second bypass divider plate (78*b*) are formed.

The first bypass divider plate (78*a*) blocks the first bypass passage (81) from the supply air passage (31) and the discharge air passage (33). The first bypass divider plate (78*a*) is detachably attached to the casing (11). The second bypass divider plate (78*b*) blocks the first bypass passage (81) from the supply fan chamber (36). The second bypass divider plate (78*b*) is provided with a first bypass damper (83). Opening or closing the first bypass damper (83) connects or disconnects the first bypass passage (81) and the supply fan chamber (36).

A starting end (an end near the back panel (13)) of the second bypass passage (82) communicates only with the room air passage (32), and is blocked from the outdoor air passage (34). The second bypass passage (82) communicates with a downstream portion of the room air filter (27) in the room air passage (32) through a communication port (76) formed in the second divider plate (75). A terminal end (an end near the front panel (12)) of the second bypass passage (82) is separated from the supply air passage (31), the discharge air passage (33), and the discharge fan chamber (35) by a divider plate (79). A second bypass damper (84) is formed in a portion of the divider plate (79) facing the discharge fan chamber (35). The second bypass damper (84) is substantially in the shape of a vertically oriented rectangle. Opening or closing the second bypass damper (84) connects or disconnects the second bypass passage (82) and the discharge fan chamber (35).

In the right side view and the left side view of FIG. 5, the first bypass passage (81), the second bypass passage (82), the first bypass damper (83), and the second bypass damper (84) are not shown.

A first open/close panel (17) constitutes a portion of the first side panel (14) of the casing (11) facing the room air passage (32) and the outdoor air passage (34). A second open/close panel (16) constitutes a portion of the first side panel (14) facing the first bypass passage (81). The first open/close panel (17) and the second open/close panel (16) are detachably attached to the casing (11).

An electrical component box (90) is attached to a right portion of the front panel (12) of the casing (11). In FIGS. 2 and 5, the electrical component box (90) is not shown. The electrical component box (90) is a rectangular parallelepiped box, and contains a control board (91), and a power supply board (92). The control board (91) and the power supply board (92) are attached to an inner side surface of one of side plates of the electrical component box (90) (i.e., a back plate) adjacent to the front panel (12). An inverter of the power supply board (92) includes a radiator fin (93). The radiator fin (93) protrudes from a back surface of the power supply board (92) to penetrate the back plate of the electrical component box (90) and the front panel (12) of the casing (11), and is exposed in the supply fan chamber (36) (see FIGS. 3 and 4).

In the casing (11), lead wires connected to the compressor (53), the fans (25, 26), the dampers (41-48), the humidity sensors (96, 97), etc., extend toward the inside of the electrical component box (90). Among them, a lead wire connected to a drive motor of the dampers (41-44) attached to the upstream divider plate (71), and lead wires connected to the humidity sensors (96, 97) extend to the electrical component box (90) through the first bypass passage (81).

<Structure of Refrigerant Circuit>

Figure 6:
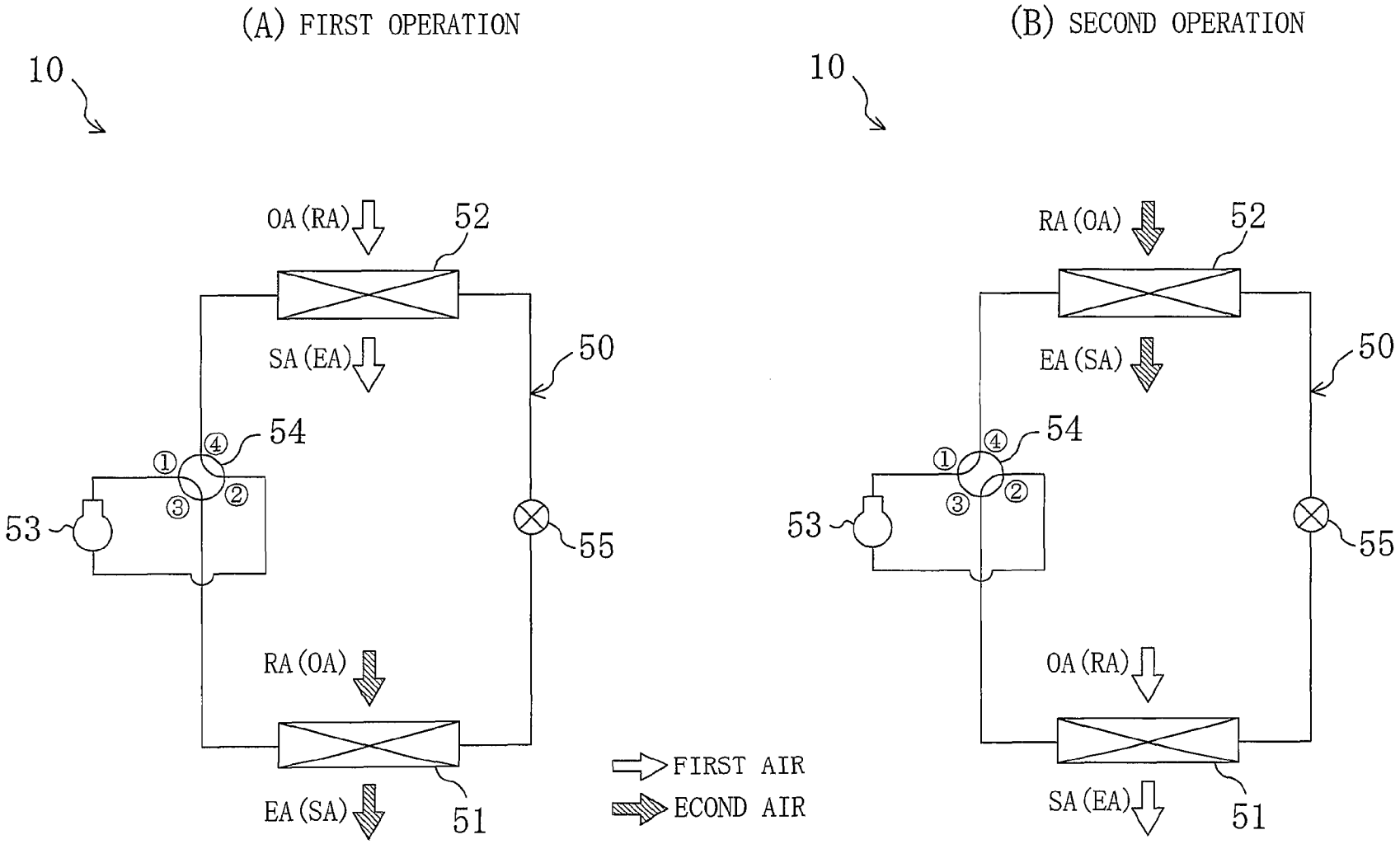
FIG. 6(A) is a piping diagram illustrating a refrigerant circuit in first operation.
FIG. 6(B) is a piping diagram illustrating the same in second operation.

The refrigerant circuit (50) will be described with reference to FIG. 6.

The refrigerant circuit (50) is a closed circuit including the first adsorption heat exchanger (51), the second adsorption heat exchanger (52), the compressor (53), the four-way switching valve (54), and the motor-operated expansion valve (55). The refrigerant circuit (50) performs a vapor compression refrigeration cycle by circulating a refrigerant filled therein.

In the refrigerant circuit (50), a discharge side of the compressor (53) is connected to a first port of the four-way switching valve (54), and a suction side is connected to a second port of the four-way switching valve (54). An end of the first adsorption heat exchanger (51) is connected to a third port of the four-way switching valve (54). The other end of the first adsorption heat exchanger (51) is connected to an end of the second adsorption heat exchanger (52) through the motor-operated expansion valve (55). The other end of the second adsorption heat exchanger (52) is connected to a fourth port of the four-way switching valve (54).

The four-way switching valve (54) is configured to be able to switch between a first state where the first and third ports communicate with each other, and the second and fourth ports communicate with each other (a state shown in FIG. 6(A)), and a second state where the first and fourth ports communicate with each other, and the second and third ports communicate with each other (a state shown in FIG. 6(B)).

Figure 7:
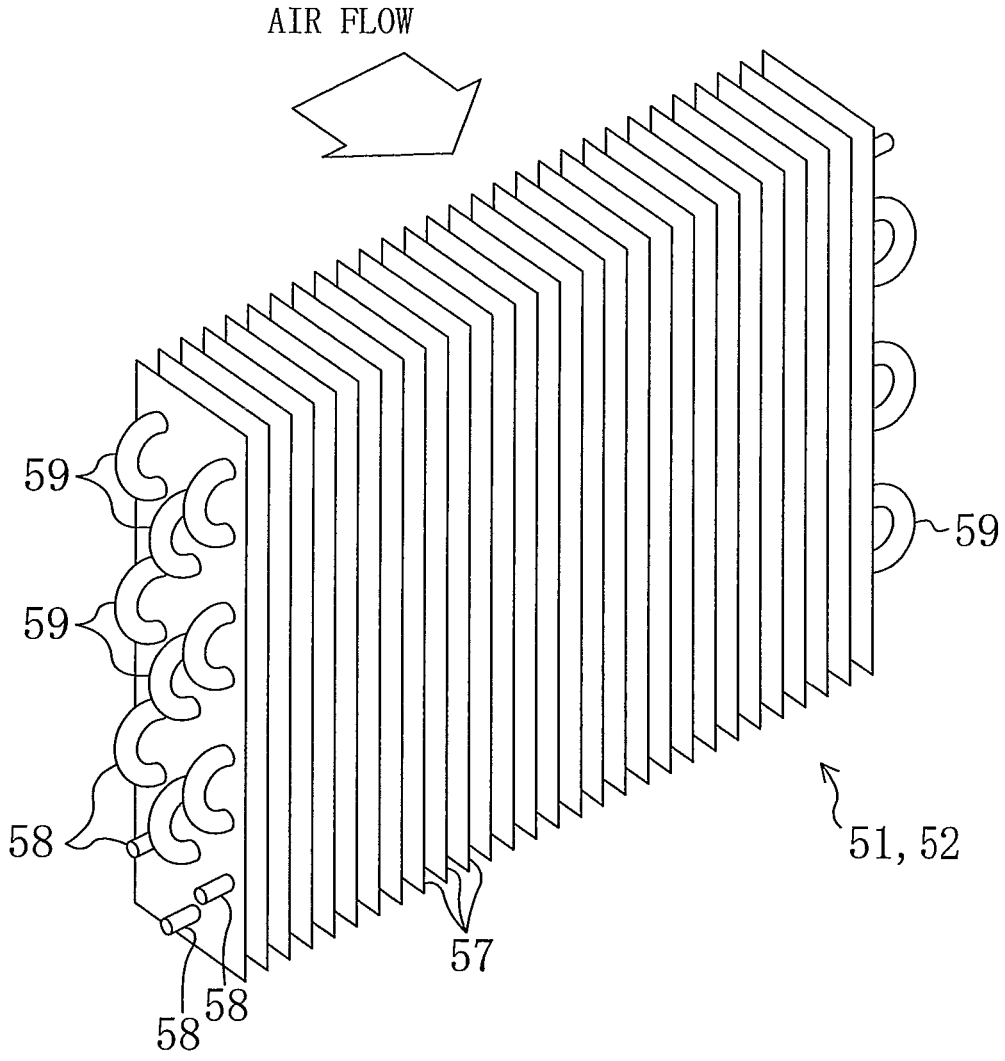
FIG. 7 is a schematic perspective view of an adsorption heat exchanger.

As shown in FIG. 7, the first adsorption heat exchanger (51) and the second adsorption heat exchanger (52) are cross-fin type fin-and-tube heat exchangers, respectively. Each of the adsorption heat exchangers (51, 52) includes copper heat transfer tubes (58), and aluminum fins (57). Each of the fins (57) of the adsorption heat exchangers (51, 52) is in the shape of a rectangular plate, and they are arranged at regular intervals. The heat transfer tubes (58) extend in the direction of alignment of the fins (57) in serpentine form. That is, the heat transfer tube (58) includes straight parts penetrating the fins (57), and U-shaped parts (59) connecting the adjacent straight parts, and they are alternately connected.

In each of the adsorption heat exchangers (51, 52), an adsorbent is supported on the surfaces of the fins (57) so as to contact with the air passing between the fins (57). The adsorbent may be a material capable of adsorbing vapor in the air, such as zeolite, silica gel, activated carbon, an organic polymer material having a hydrophilic functional group, etc.

In the humidity control apparatus (10) of the present embodiment, the refrigerant circuit (50) constitutes a heating medium circuit. In the refrigerant circuit (50), a high pressure gaseous refrigerant is supplied as a heating fluid medium to one of the two adsorption heat exchangers (51, 52) serving as a condenser, and a low pressure gas-liquid two-phase refrigerant is supplied as a cooling fluid medium to the other adsorption heat exchanger (51, 52) serving as an evaporator.

<Detailed Structure of Damper Unit>

In the humidity control apparatus (10), a pair of laterally adjacent dampers constitute the damper unit (100). Specifically, on the upstream divider plate (71), the laterally adjacent first and second dampers (41, 42) constitute a single damper unit (100), and the laterally adjacent third and fourth dampers (43, 44) constitute a single damper unit (100). On the downstream divider plate (72), the laterally adjacent fifth and sixth dampers (45, 46) constitute a single damper unit (100), and the laterally adjacent seventh and eighth dampers (47, 48) constitute a single damper unit (100). The damper units (100) can be drawn out of the casing (11) toward the first side panel (14) (the second open/close panel (16)).

Detailed structure of the damper units (100) will be described with reference to FIGS. 8 to 11. The damper units (100, 100) on the upstream divider plate (71), and the damper units (100, 100) on the downstream divider plate (72) are basically configured in the same manner Therefore, the damper units (100) on the upstream divider plate (71) will be described below.

Figure 8:
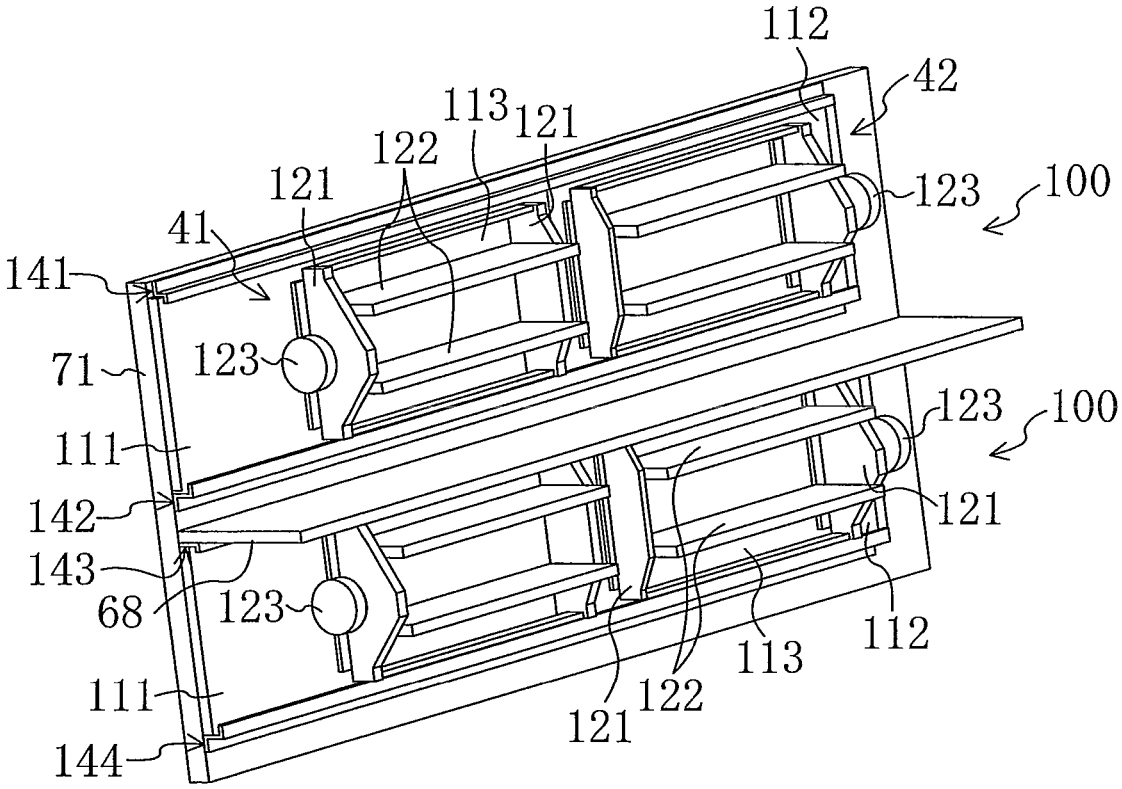
FIG. 8 is a perspective view illustrating an upstream divider plate with a damper unit attached thereto.

As shown in FIG. 8, each of the paired adjacent dampers (41, 42, 43, 44) in the damper unit (100) includes a frame (111, 112), and a damper body (120). Each of the frames (111, 112) is in the shape of a horizontally oriented rectangular plate. A horizontally oriented rectangular damper opening (113) is formed in each of the frames (111, 112). The damper body (120) is attached to the frame (111, 112) to cover the damper opening (113).

In each of the damper units (100), the frame close to the first side panel (14) constitutes a front frame (111), and the frame far from the first side panel (14) constitutes a back frame (112). A longitudinal dimension of the front frame (111) is larger than a longitudinal dimension of the back frame (112). In the front frame (111), the opening (113) and the damper body (120) are slightly shifted to the left from the longitudinal center of the front frame (toward the second side panel (15)). In each of the damper units (100), the damper body (120) and the opening (113) are aligned with the corresponding air flow port (41*a*-48*a*).

The damper body (120) includes a pair of support plates (121, 121), two shutters (122, 122), and a motor (123). The support plates (121, 121) are arranged to vertically stand on the frame (111, 112) along the lateral ends of the damper opening (113). Each of the support plates (121, 121) is substantially in the shape of a trapezoid with a proximal side supported on the frame (111, 112) is longer than a distal side. The two shutters (122, 122) are interposed between the pair of support plates (121, 121). Each of the shutters (122, 122) is in the shape of a horizontally oriented rectangular plate. The shutters (122, 122) are parallel to each other with their longitudinal ends pivotally supported by the support plates (121, 121). The damper body (120) includes a pair of reinforcement members extending to couple upper ends and lower ends of the pair of support plates (121, 121), respectively.

The motor (123) is attached to one of the two support plates (121). Specifically, in the front frame (111), the motor (123) is attached to the support plate (121) close to the first side panel (14). In the back frame (112), the motor (123) is attached to the support plate (121) far from the first side panel (14). The motor (123) changes the rotation of the two shutters depending on whether the power is on or off. The rotation of the shutters (122, 122) opens or closes the openings (113), i.e., the air flow ports (41*a*-48*a*).

The upstream divider plate (71) includes four rails (141, 142, 143, 144). Each of the rails (141-144) constitutes a guide member for guiding the damper unit (100) in a drawing direction toward the outside of the casing (11). The rails (141-144) are parallel to each other, and extend along the upstream divider plate (71). Specifically, the rails (141-144) extend in the drawing direction of the damper unit (100). Each of the rails (141-144) is formed by bending long sheet metal several times, and a vertical cross-sectional shape thereof remains the same in the longitudinal direction.

On a portion facing the room air passage (32) of the upstream divider plate (71), a first rail (141) is attached above the first and second dampers (41, 42), and a second rail (142) is attached below the first and second dampers (41, 42). On a portion facing the outdoor air passage (34) of the upstream divider plate (71), a third rail (143) is attached above the third and fourth dampers (43, 44), and a fourth rail (144) is attached below the third and fourth dampers (43, 44).

Figure 9:
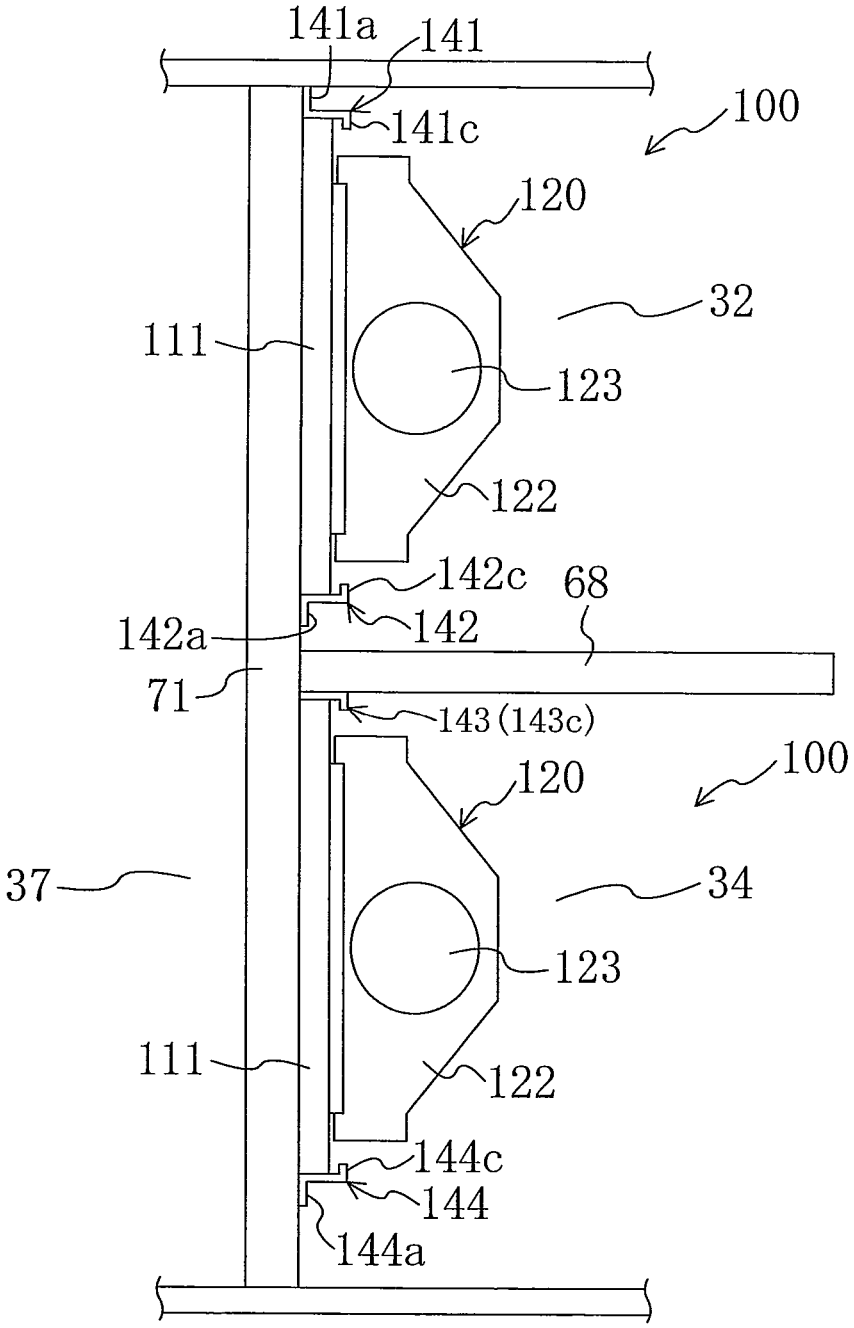
FIG. 9 is a vertical cross-sectional view illustrating the upstream divider plate with the damper unit attached thereto.

As shown in FIG. 9, the first rail (141) includes a side plate (141*a*) and a guide plate (141*c*) coupled to each other. The side plate (141*a*) of the first rail (141) is in contact with, and is fixed to the upstream divider plate (71). The guide plate (141*c*) of the first rail (141) is bent downward in the shape of L when viewed in vertical section. The second rail (142) includes a side plate (142*a*) and a guide plate (142*c*) coupled to each other. The side plate (142*a*) of the second rail (142) is in contact with, and is fixed to the upstream divider plate (71). The guide plate (142*c*) of the second rail (142) is bent upward in the shape of L when viewed in vertical section.

The third rail (143) constitutes a guide plate (143*c*) which is bent downward when viewed in vertical section. An upper surface of the third rail (143) is in contact with, and is fixed to a lower surface of the first horizontal divider plate (68).

The fourth rail (144) includes a side plate (144*a*) and a guide plate (144*c*) coupled to each other. The side plate (144*a*) of the fourth rail (144) is in contact with, and is fixed to the upstream divider plate (71). The guide plate (144*c*) of the fourth rail (144) is bent upward in the shape of L when viewed in vertical section.

A guide groove is formed between the guide plate (141*c*-144*c*) of each of the rails (141-144) and the upstream divider plate (71) to extend between the longitudinal ends of the rail. Upper ends of the frames (111, 112) of the first and second dampers (41, 42) fit in the guide groove of the first rail (141), and lower ends of the frames fit in the guide groove of the second rail (142). Upper ends of the frames (111, 112) of the third and fourth dampers (43, 44) fit in the guide groove of the third rail (143), and lower ends of the frames fit in the guide groove of the fourth rail (142).

Figure 10:
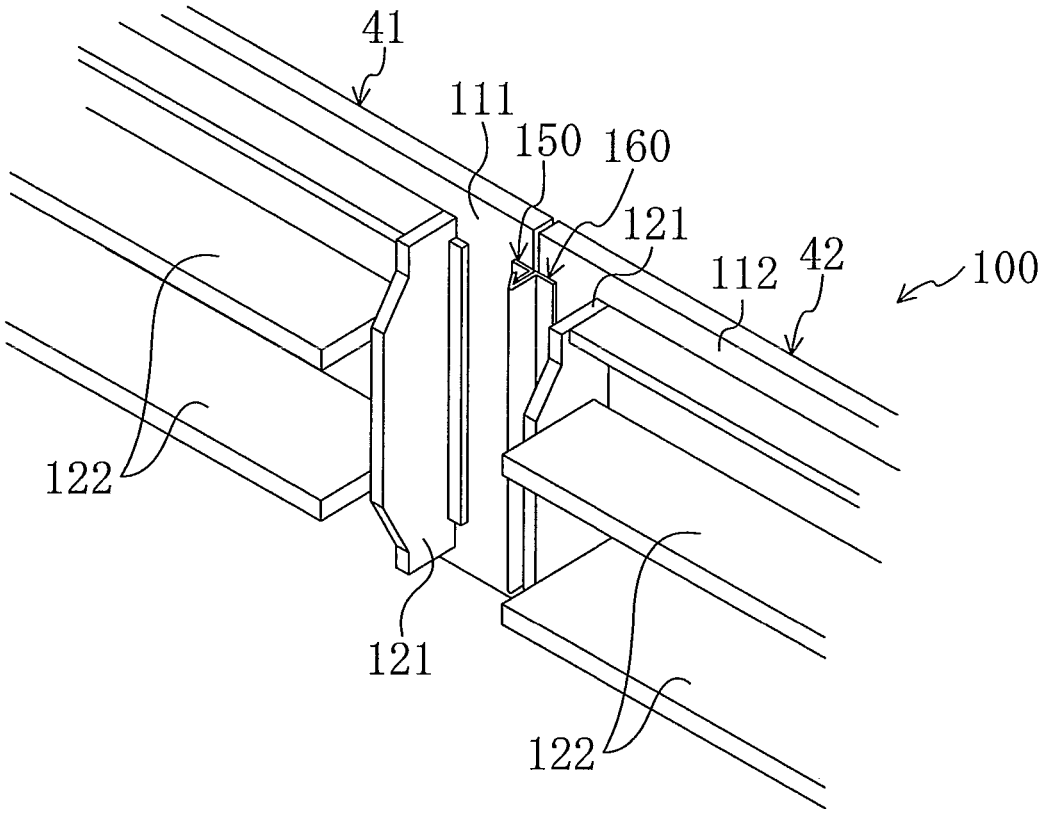
FIG. 10 is a perspective view illustrating adjacent dampers being coupled.
Figure 11:
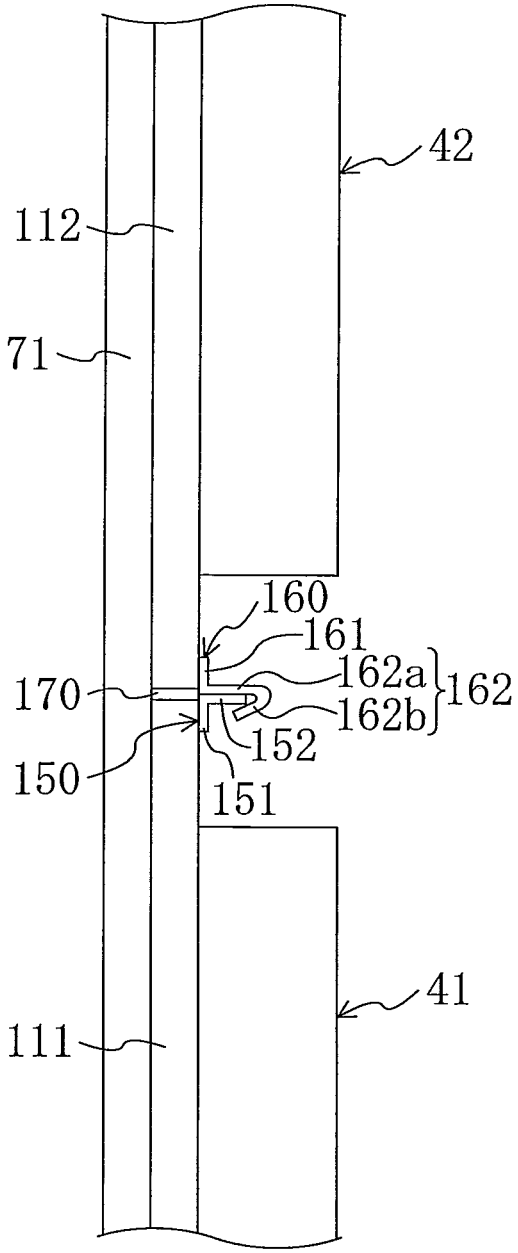
FIG. 11 is a plan view illustrating the adjacent dampers being coupled.

Each of the damper units (100) includes a coupling mechanism (150, 160) for coupling the adjacent dampers. The coupling mechanism includes an L-shaped plate (150), and a hook plate (160). Specifically, for example, as shown in FIGS. 10 and 11, each of the damper unit (100) includes the L-shaped plate (150) provided at a coupling end of the front frame (111), and the hook plate (160) provided at a coupling end of the back frame (112).

The L-shaped plate (150) and the hook plate (160) vertically extend along the coupling end of the corresponding frame (111, 122). Specifically, the L-shaped plate (150) and the hook plate (160) are orthogonal to the rails (141-144), and are parallel to the first side panel (14). The L-shaped plate (150) and the hook plate (160) are formed by bending sheet metal several times, and a horizontal cross-sectional shape thereof remains the same in the longitudinal direction.

The L-shaped plate (150) includes a base (151) which is in contact with, and is fixed to a back surface of the front frame (111), and a flat protrusion (152) vertically extending from the base (151). The flat protrusion (152) protrudes toward the back panel (13) to be orthogonal to the base (151).

The hook plate (160) includes a base (161) which is in contact with, and is fixed to a back surface of the back frame (112), and a flat hook (162) vertically extending from the base (161). The flat hook (162) includes a protruding portion (162*a*) protruding toward the back panel (13) to be orthogonal to the base (161), and a bent portion (162*b*) joined to a tip end of the flat protrusion (162*a*), and is bent toward the upstream divider plate (71). Specifically, the flat hook (162) is bent to cover the flat protrusion (152) between the protruding portion (162*a*) and the bent portion (162*b*).

The coupling mechanism (150, 160) is configured to separably couple the adjacent dampers. Specifically, for example, in a first damper unit (100), the flat protrusion (152) of the front frame (111) and the flat hook (162) of the back frame (112) constitute a pair of engagement sections, and the adjacent dampers (41, 42) are coupled to each other by engaging the engagement sections. The flat protrusion (152) and the flat hook (162), once engaged with each other, are prevented from disengaging in the drawing direction. Further, with this engagement, the flat protrusion (152) and the flat hook (162) are allowed to disengage in a direction different from the drawing direction of the dampers (41, 42). In drawing each of the damper units (100), the flat protrusion (152) and the flat hook (162) can be separated from each other by disengaging them. The drawing (maintenance) of the damper unit (100) will be described below.

In each of the damper units (100), a small gap is formed between the coupled front frame (111) and back frame (112). The gap between the coupled frames of each of the damper units (100) faces the upstream divider plate (71) (see FIG. 11). This can reduce leakage of the air between the heat exchange chambers (37, 38), and the room air passage (32) and the outdoor air passage (34). A sealing member (170) for filling the gap is provided between the front frame (111) and the back frame (112). The sealing member (170) is fixed to one or both of an end face of the front frame (111) and an end face of the back frame (112). The sealing member (170) prevents the air leakage between the heat exchange chambers (37, 38), and the room air passage (32) and the outdoor air passage (34).

Operation Mechanism

The humidity control apparatus (10) of the present embodiment selectively performs dehumidification/ventilation operation, humidification/ventilation operation, and simple ventilation operation. During the dehumidification/ventilation operation and the humidification/ventilation operation, the humidity control apparatus (10) takes the outdoor air (OA) therein for humidity control, and the humidity-controlled air is supplied to the inside of the room as supply air (SA), and simultaneously, the humidity control apparatus (10) takes the indoor air (RA) and discharges it as exhaust air (EA). During the simple ventilation operation, the humidity control apparatus (10) takes the outdoor air (OA) and supplies it to the inside of the room as the supply air (SA), and simultaneously, the humidity control apparatus (10) takes the room air (RA), and discharges it as the exhaust air (EA).

<Dehumidification/Ventilation Operation>

In the humidity control apparatus (10) performing the dehumidification/ventilation operation, first operation and second operation described later are alternately performed at predetermined time intervals (e.g., every three minutes). In the dehumidification/ventilation operation, the first bypass damper (83) and the second bypass damper (84) are kept closed.

When the supply fan (26) of the humidity control apparatus (10) is operated in the dehumidification/ventilation operation, the outdoor air enters the casing (11) through the outdoor air inlet (24) as first air. When the discharge fan (25) is operated, the room air enters the casing (11) through the indoor air inlet (23) as second air.

Figure 12:
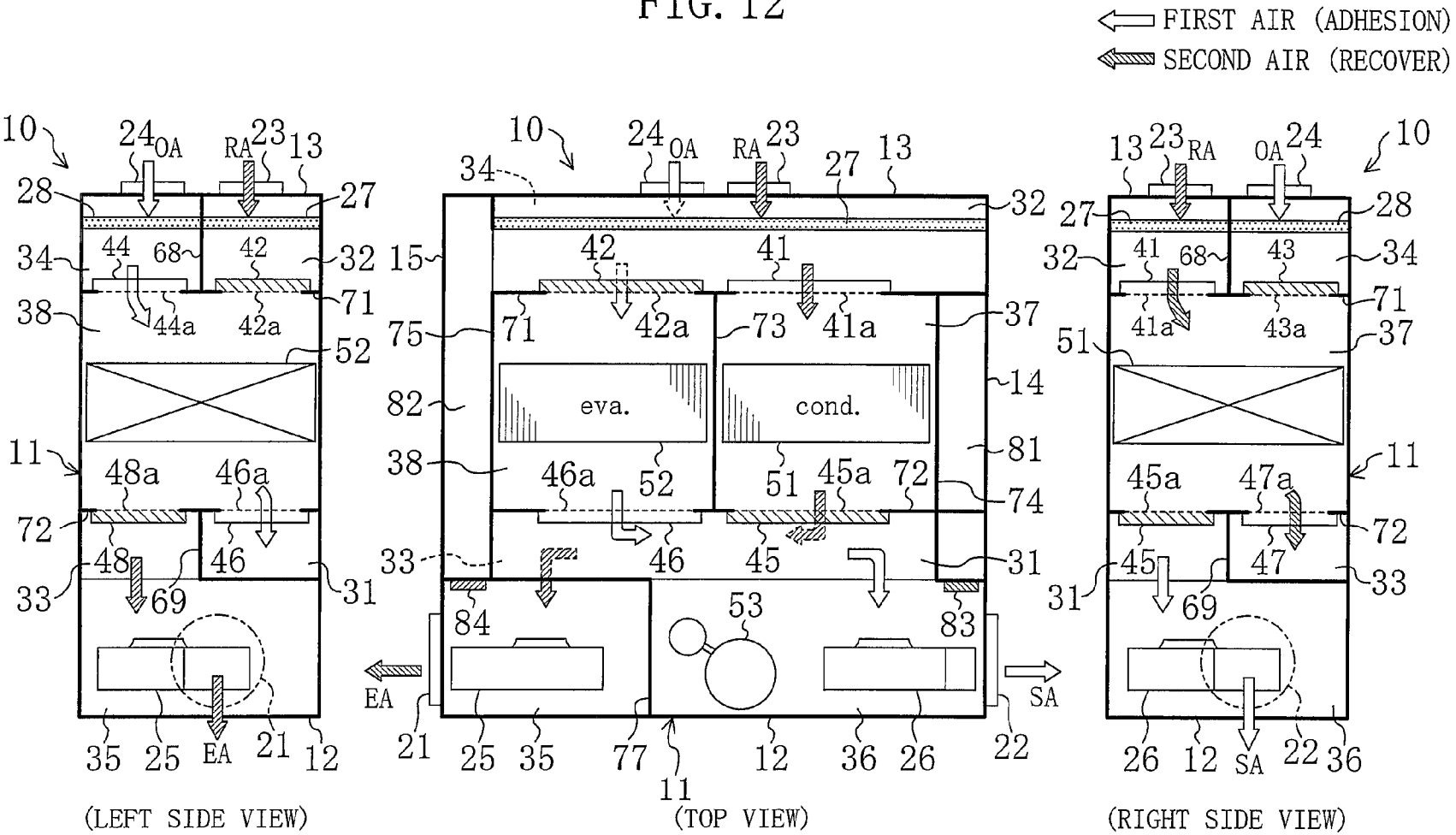
FIG. 12 schematically shows a plan view, a right side view, and a left side view of the humidity control apparatus, together with a flow of air in first operation of dehumidification/ventilation operation.

The first operation of the dehumidification/ventilation operation will be described below. As shown in FIG. 12, in the first operation, the first damper (41), the fourth damper (44), the sixth damper (46), and the seventh damper (47) are opened, and the second damper (42), the third damper (43), the fifth damper (45), and the eighth damper (48) are closed.

In the first operation, the four-way switching valve (54) in the refrigerant circuit (50) is set to the first state as shown in FIG. 6(A). In this state, the refrigerant in the refrigerant circuit (50) circulates to perform a refrigeration cycle. In this case, in the refrigerant circuit (50), the refrigerant discharged from the compressor (53) sequentially passes through the first adsorption heat exchanger (51), the motor-operated expansion valve (55), and the second adsorption heat exchanger (52). The first adsorption heat exchanger (51) functions as a condenser, and the second adsorption heat exchanger (52) functions as an evaporator.

The first air that entered the outdoor air passage (34), and passed through the outdoor air filter (28) passes through the fourth air flow port (44*a*) to enter the second heat exchange chamber (38), and then passes through the second adsorption heat exchanger (52). In the second adsorption heat exchanger (52), moisture in the first air is adsorbed by the adsorbent, and heat generated by the adsorption is absorbed by the refrigerant. The first air dehumidified by the second adsorption heat exchanger (52) passes through the sixth air flow port (46*a*) to enter the supply air passage (31), passes through the supply fan chamber (36), and is supplied to the inside of the room through the supply port (22).

The second air that entered the room air passage (32), and passed through the room air filter (27) passes through the first air flow port (41*a*) to enter the first heat exchange chamber (37), and then passes through the first adsorption heat exchanger (51). In the first adsorption heat exchanger (51), the adsorbent heated by the refrigerant releases the moisture, and the released moisture is given to the second air. The second air containing the moisture given by the first adsorption heat exchanger (51) passes through the seventh air flow port (47*a*) to enter the discharge air passage (33), passes through the discharge fan chamber (35), and is discharged outside the room through the discharge port (21).

Figure 13:
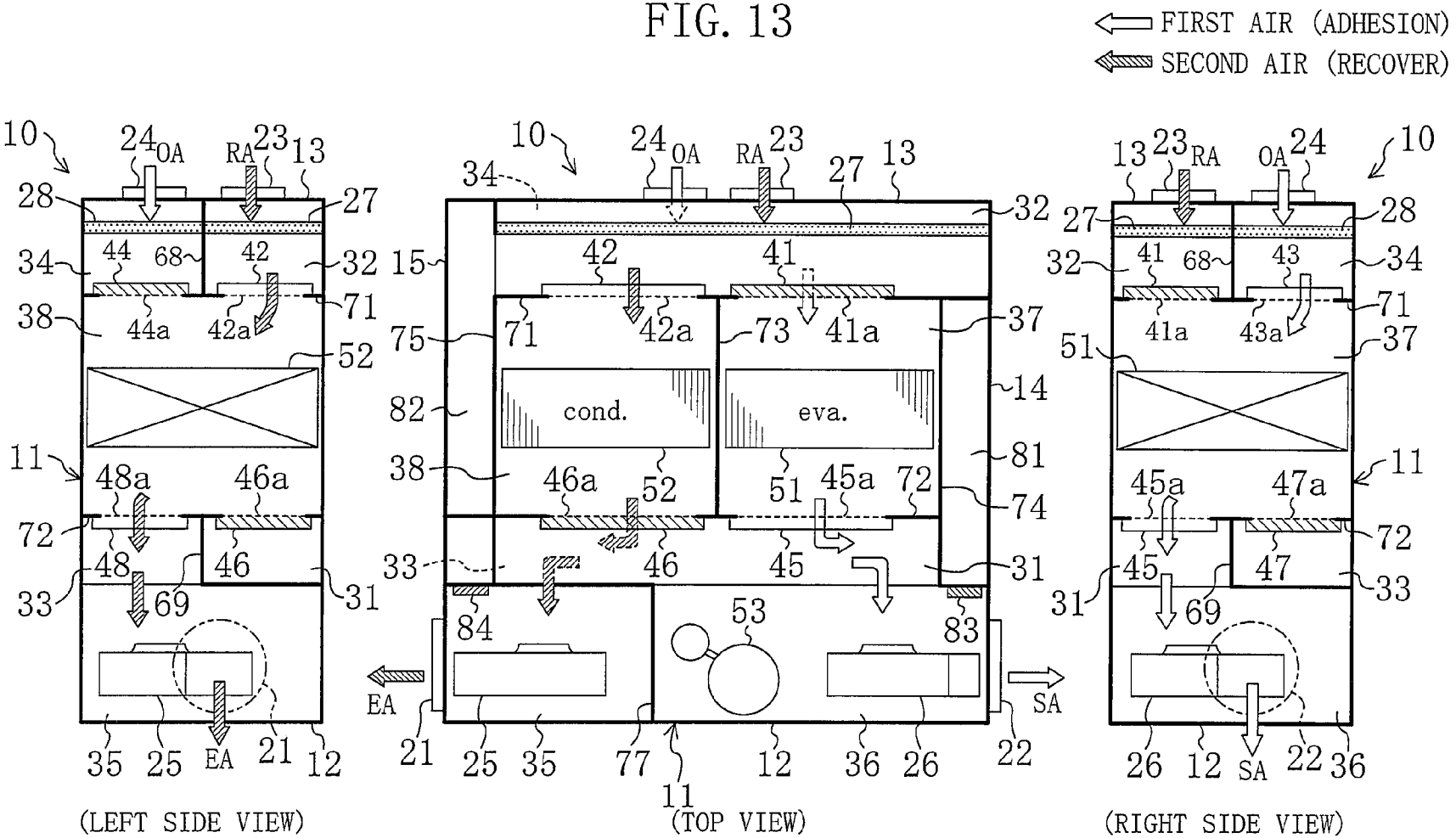
FIG. 13 schematically shows a plan view, a right side view, and a left side view of the humidity control apparatus, together with a flow of air in second operation of the dehumidification/ventilation operation.

The second operation of the dehumidification/ventilation operation will be described below. As shown in FIG. 13, in the second operation, the second damper (42), the third damper (43), the fifth damper (45), and the eighth damper (48) are opened, and the first damper (41), the fourth damper (44), the sixth damper (46), and the seventh damper (47) are closed.

In the second operation, the four-way switching valve (54) in the refrigerant circuit (50) is set to the second state as shown in FIG. 6(B). In this state, the refrigerant in the refrigerant circuit (50) circulates to perform a refrigeration cycle. In this case, in the refrigerant circuit (50), the refrigerant discharged from the compressor (53) sequentially passes through the second adsorption heat exchanger (52), the motor-operated expansion valve (55), and the first adsorption heat exchanger (51). The first adsorption heat exchanger (51) functions as the evaporator, and the second adsorption heat exchanger (52) functions as the condenser.

The first air that entered the outdoor air passage (34), and passed through the outdoor air filter (28) passes through the third air flow port (43*a*) to enter the first heat exchange chamber (37), and then passes through the first adsorption heat exchanger (51). In the first adsorption heat exchanger (51), moisture in the first air is adsorbed by the adsorbent, and heat generated by the adsorption is absorbed by the refrigerant. The first air dehumidified by the first adsorption heat exchanger (51) passes through the fifth air flow port (45*a*) to enter the supply air passage (31), passes through the supply fan chamber (36), and is supplied to the inside of the room through the supply port (22).

The second air that entered the room air passage (32), and passed through the room air filter (27) passes through the second air flow port (42*a*) to enter the second heat exchange chamber (38), and then passes through the second adsorption heat exchanger (52). In the second adsorption heat exchanger (52), the adsorbent heated by the refrigerant releases the moisture, and the released moisture is given to the second air. The second air containing the moisture given by the second adsorption heat exchanger (52) passes through the eighth air flow port (48*a*) to enter the discharge air passage (33), passes through the discharge fan chamber (35), and is discharged outside the room through the discharge port (21).

<Humidification/Ventilation Operation>

In the humidity control apparatus (10) performing the humidification/ventilation operation, first operation and second operation described later are alternately performed at predetermined time intervals (e.g., every three minutes). In the humidification/ventilation operation, the first bypass damper (83) and the second bypass damper (84) are kept closed.

When the supply fan (26) of the humidity control apparatus (10) is operated in the humidification/ventilation operation, the outdoor air enters the casing (11) through the outdoor air inlet (24) as second air. When the discharge fan (25) is operated, the room air enters the casing (11) through the indoor air inlet (23) as first air.

Figure 14:
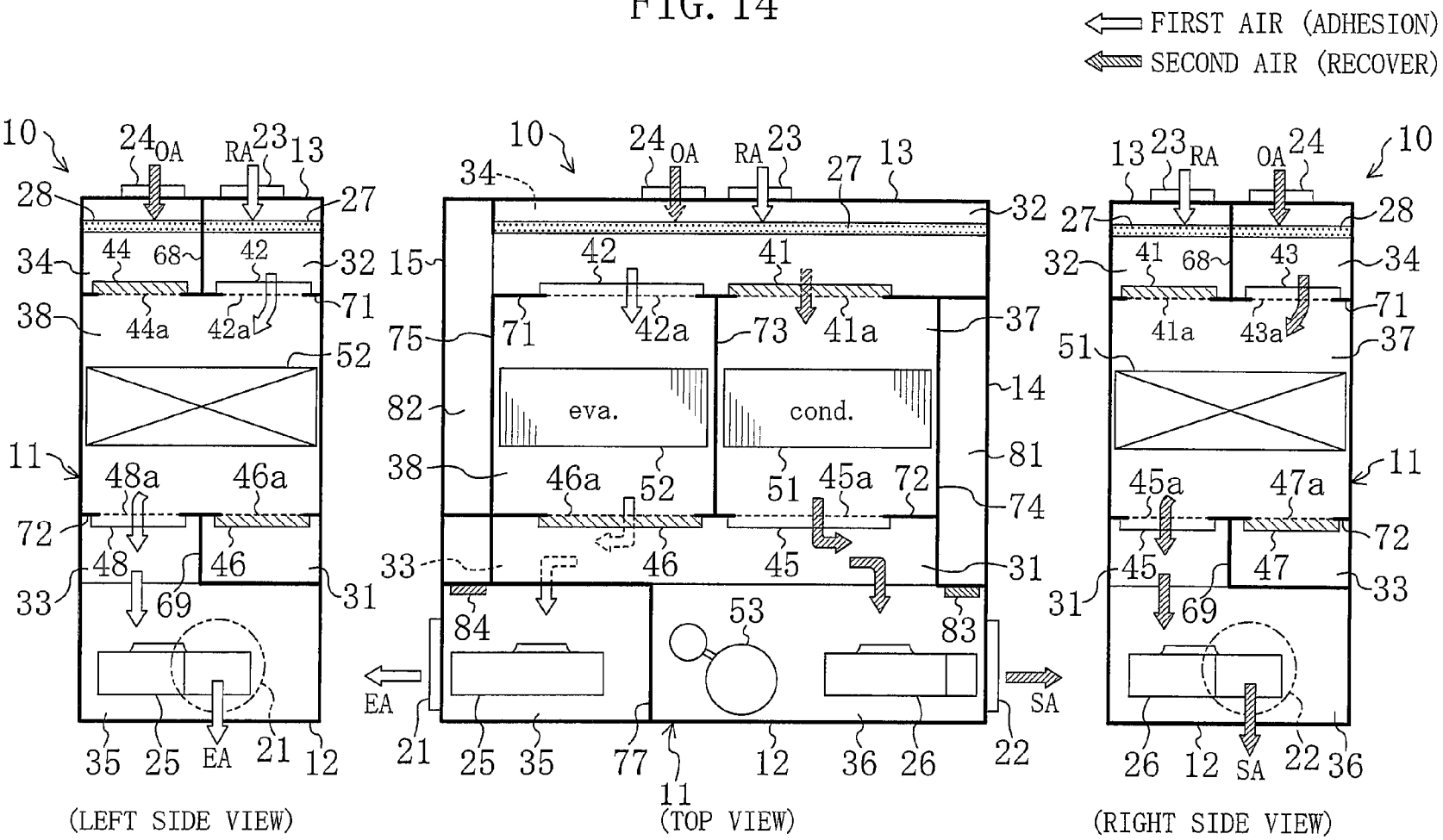
FIG. 14 schematically shows a plan view, a right side view, and a left side view of the humidity control apparatus, together with a flow of air in first operation of humidification/ventilation operation.

The first operation of the humidification/ventilation operation will be described below. As shown in FIG. 14, in the first operation, the second damper (42), the third damper (43), the fifth damper (45), and the eighth damper (48) are opened, and the first damper (41), the fourth damper (44), the sixth damper (46), and the seventh damper (47) are closed.

In the first operation, the four-way switching valve (54) in the refrigerant circuit (50) is set to the first state as shown in FIG. 6(A). In this state, like the first operation in the dehumidification/ventilation operation, the first adsorption heat exchanger (51) functions as the condenser, and the second adsorption heat exchanger (52) functions as the evaporator.

The first air that entered the room air passage (32), and passed through the room air filter (27) passes through the second air flow port (42*a*) to enter the second heat exchange chamber (38), and then passes through the second adsorption heat exchanger (52). In the second adsorption heat exchanger (52), moisture in the first air is adsorbed by the adsorbent, and heat generated by the adsorption is absorbed by the refrigerant. The first air that lost the moisture in the second adsorption heat exchanger (52) passes through the eighth air flow port (48*a*) to enter the discharge air passage (33), passes through the discharge fan chamber (35), and is discharged outside the room through the discharge port (21).

The second air that entered the outdoor air passage (34), and passed through the outdoor air filter (28) passes through the third air flow port (43*a*) to enter the first heat exchange chamber (37), and then passes through the first adsorption heat exchanger (51). In the first adsorption heat exchanger (51), the adsorbent heated by the refrigerant releases the moisture, and the released moisture is given to the second air. The second air humidified by the first adsorption heat exchanger (51) passes through the fifth air flow port (45*a*) to enter the supply air passage (31), passes through the supply fan chamber (36), and is supplied to the inside of the room through the supply port (22).

Figure 15:
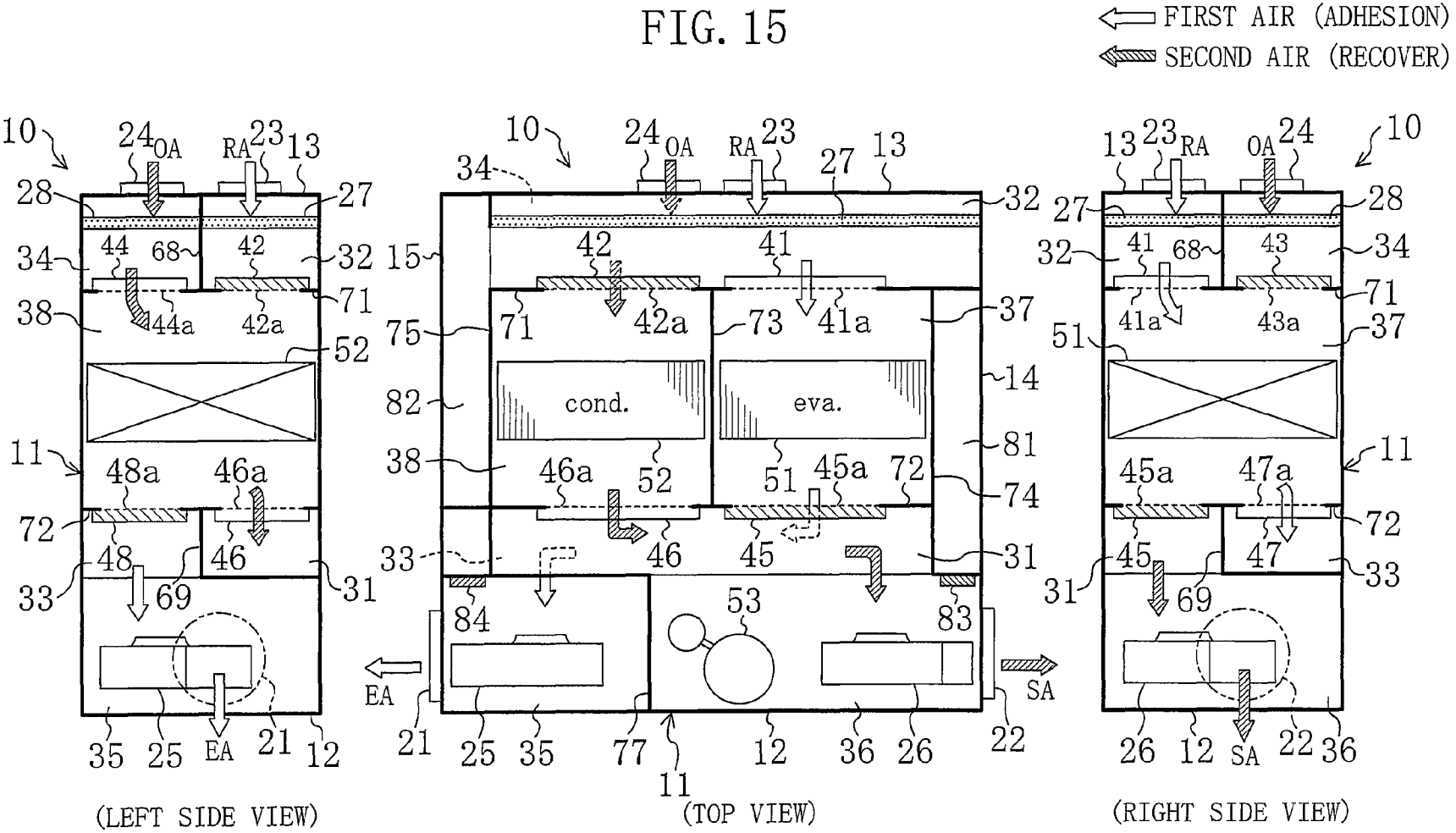
FIG. 15 schematically shows a plan view, a right side view, and a left side view of the humidity control apparatus, together with a flow of air in second operation of the humidification/ventilation operation.

The second operation of the humidification/ventilation operation will be described below. As shown in FIG. 15, in the second operation, the first damper (41), the fourth damper (44), the sixth damper (46), and the seventh damper (47) are opened, and the second damper (42), the third damper (43), the fifth damper (45), and the eighth damper (48) are closed.

In the second operation, the four-way switching valve (54) in the refrigerant circuit (50) is set to the second state as shown in FIG. 6(B). In this state, in the refrigerant circuit (50), like the second operation of the dehumidification/ventilation operation, the first adsorption heat exchanger (51) functions as the evaporator, and the second adsorption heat exchanger (52) functions as the condenser.

The first air that entered the room air passage (32), and passed through the room air filter (27) passes through the first air flow port (41*a*) to enter the first heat exchange chamber (37), and then passes through the first adsorption heat exchanger (51). In the first adsorption heat exchanger (51), moisture in the first air is adsorbed by the adsorbent, and heat generated by the adsorption is absorbed by the refrigerant. The first air that lost the moisture in the first adsorption heat exchanger (51) passes through the seventh air flow port (47*a*) to enter the discharge air passage (33), passes through the discharge fan chamber (35), and is discharged outside the room through the discharge port (21).

The second air that entered the outdoor air passage (34), and passed through the outdoor air filter (28) passes through the fourth air flow port (44*a*) to enter the second heat exchange chamber (38), and then passes through the second adsorption heat exchanger (52). In the second adsorption heat exchanger (52), the adsorbent heated by the refrigerant releases the moisture, and the released moisture is given to the second air. The second air humidified by the second adsorption heat exchanger (52) passes through the sixth air flow port (46*a*) to enter the supply air passage (31), passes through the supply fan chamber (36), and is supplied to the inside of the room through the supply port (22).

<Simple Ventilation Operation>

Figure 16:
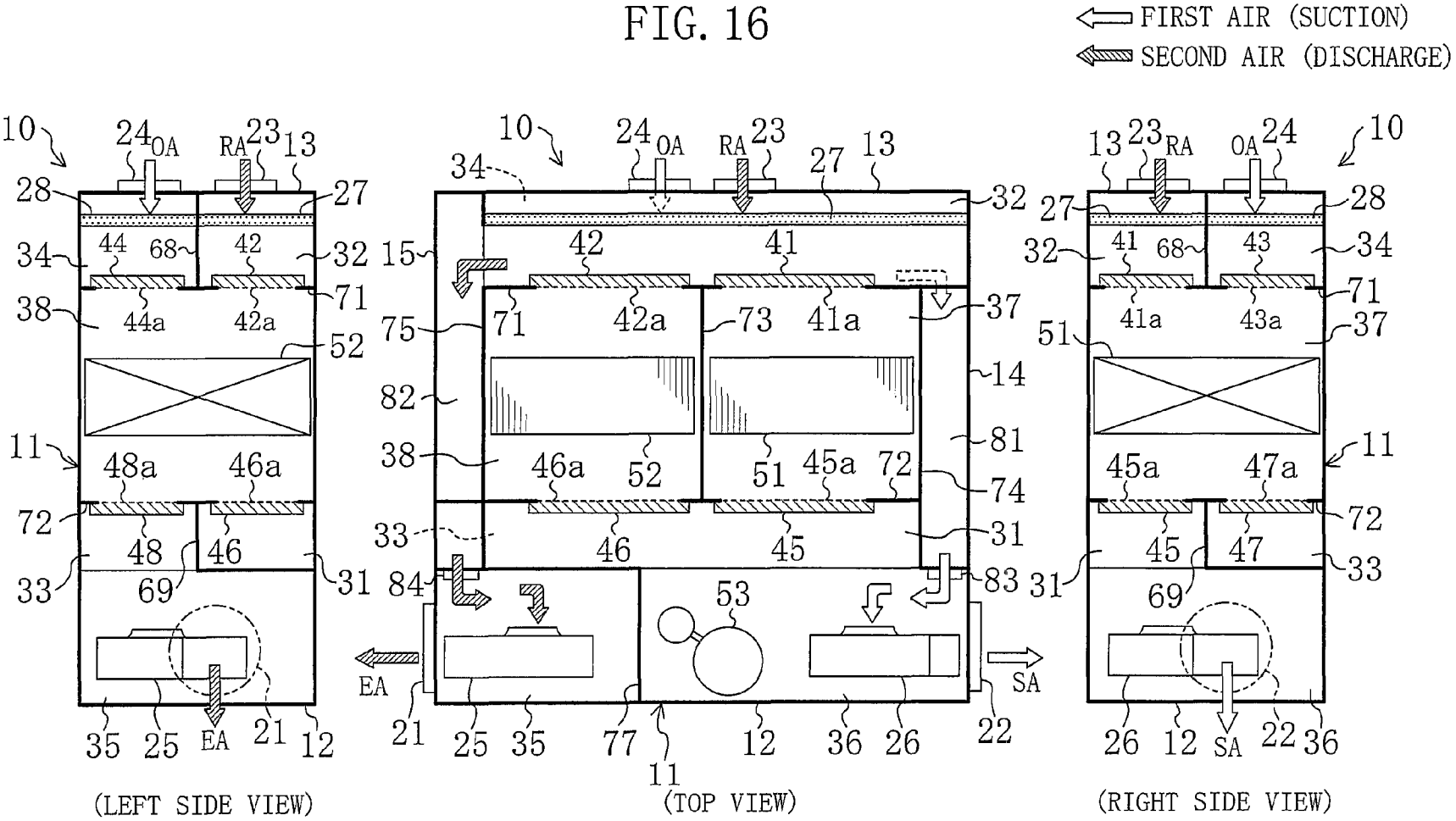
FIG. 16 schematically shows a plan view, a right side view, and a left side view of the humidity control apparatus, together with a flow of air in simple ventilation operation.

Operation of the humidity control apparatus (10) during the simple ventilation operation will be described with reference to FIG. 16. The simple ventilation operation is performed when direct supply of the outdoor air to the inside of the room does not affect comfortability of the inside the room (e.g., in an intermediate season, such as spring and summer). Specifically, the simple ventilation operation is performed when the humidity control of the air supplied to the inside of the room is not required, but the ventilation of the inside of the room is required.

In the simple ventilation operation, the first and second bypass dampers (83, 84) are opened, and the first to eighth dampers (41-48) are all closed. In the simple ventilation operation, the compressor (53) in the refrigerant circuit (50) is suspended. That is, the refrigeration cycle is not performed in the refrigerant circuit (50) in the simple ventilation operation.

In the simple ventilation operation, when the supply fan (26) of the humidity control apparatus (10) is operated, the outdoor air enters the casing (11) through the outdoor air inlet (24). The outdoor air that entered the outdoor air passage (34) through the outdoor air inlet (24) passes through the outdoor air filter (28) to enter the first bypass passage (81), and passes through the first bypass damper (83) to enter the supply fan chamber (36). The outdoor air that entered the supply fan chamber (36) is sucked by the supply fan (26), and is supplied to the inside of the room through the supply port (22).

In the simple ventilation operation, when the discharge fan (25) of the humidity control apparatus (10) is operated, the room air enters the casing (11) through the indoor air inlet (23). The room air that entered the room air passage (32) through the indoor air inlet (23) passes through the room air filter (27) to enter the second bypass passage (82), and passes through the second bypass damper (84) to enter the discharge fan chamber (35). The room air that entered the discharge fan chamber (35) is sucked by the discharge fan (25), and is discharged outside the room through the discharge port (21).

<Attachment/Detachment of Damper>

Attachment/detachment of the first to eighth dampers (41-48) will be described below. In the humidity control apparatus (10), detachment from the casing (11) and attachment to the casing (11) are performed on every four damper units (100).

Specifically, for example, in detaching the damper units (100) on the upstream divider plate (71) from the outside of the casing (11), the first open/close panel (17) shown in FIG. 1 is detached from the casing (11), thereby bringing the casing in the state shown in FIG. 2. For example, in drawing the damper units (100) out of the room air passage (32), a worker pulls the front frame (111) of the first damper (41) toward the first side panel (14).

The front frame (111) and the back frame (112) are coupled to each other through the L-shaped plate (150) and the hook plate (160) (see FIG. 11). That is, the first damper (41) and the second damper (42) constitute an integrated damper unit (100) with the flat hook (162) hooked on the flat protrusion (152). Therefore, in drawing the first damper (41) out of the casing, the second damper (42) is simultaneously drawn out. In this case, the flat protrusion (152) and the flat hook (162) are prevented from disengaging in the drawing direction. Therefore, the flat protrusion (152) will not be detached from the flat hook (162).

By pulling the damper unit (100) in this way, the first damper (41) and the second damper (42) are guided by the guide groove of the first rail (141) and the second rail (142) to move toward the first side panel (14). As a result, the first damper (41) is first drawn out of the casing (11) (see FIG. 17).

Figure 17:
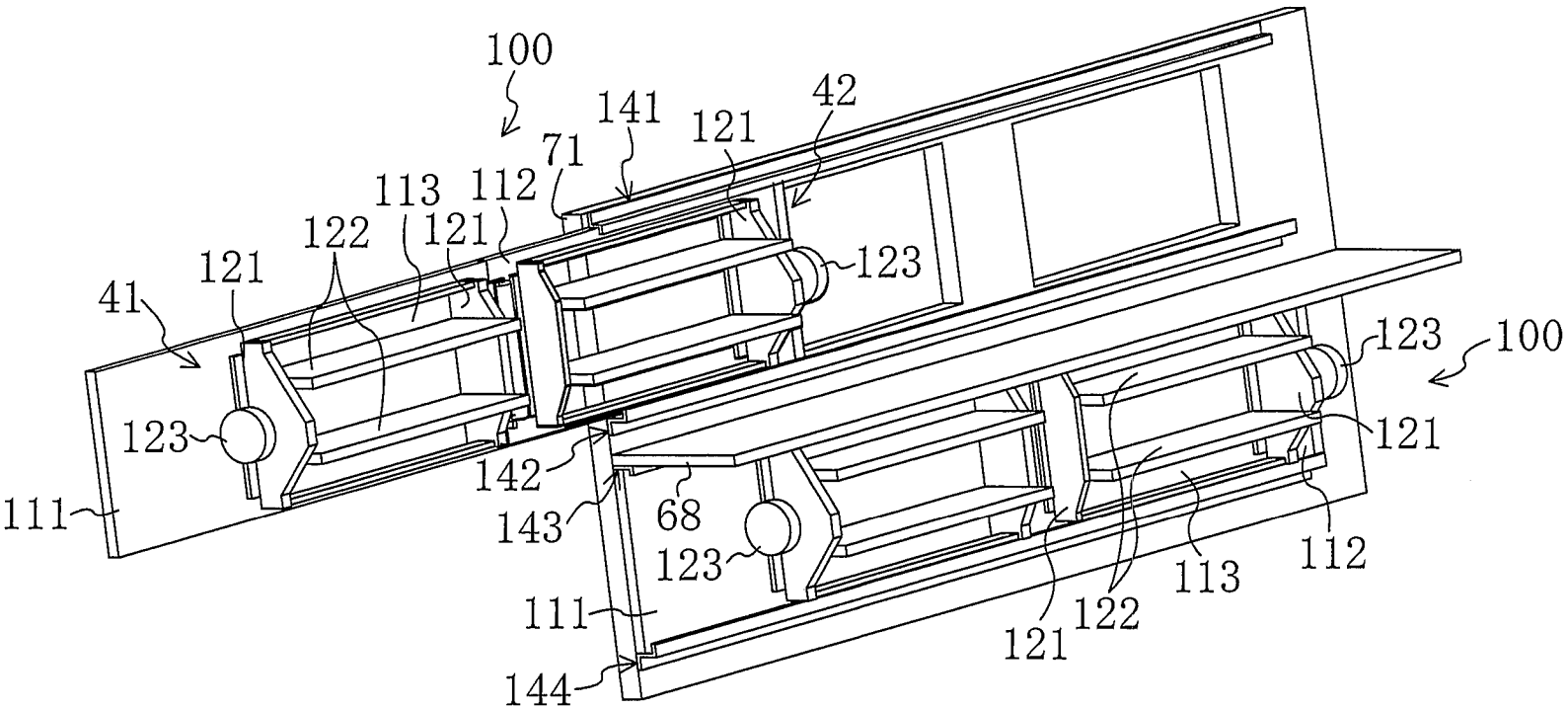
FIG. 17 is a perspective view illustrating how the damper unit is detached, in which a front frame is drawn out of the casing.
Figure 18:
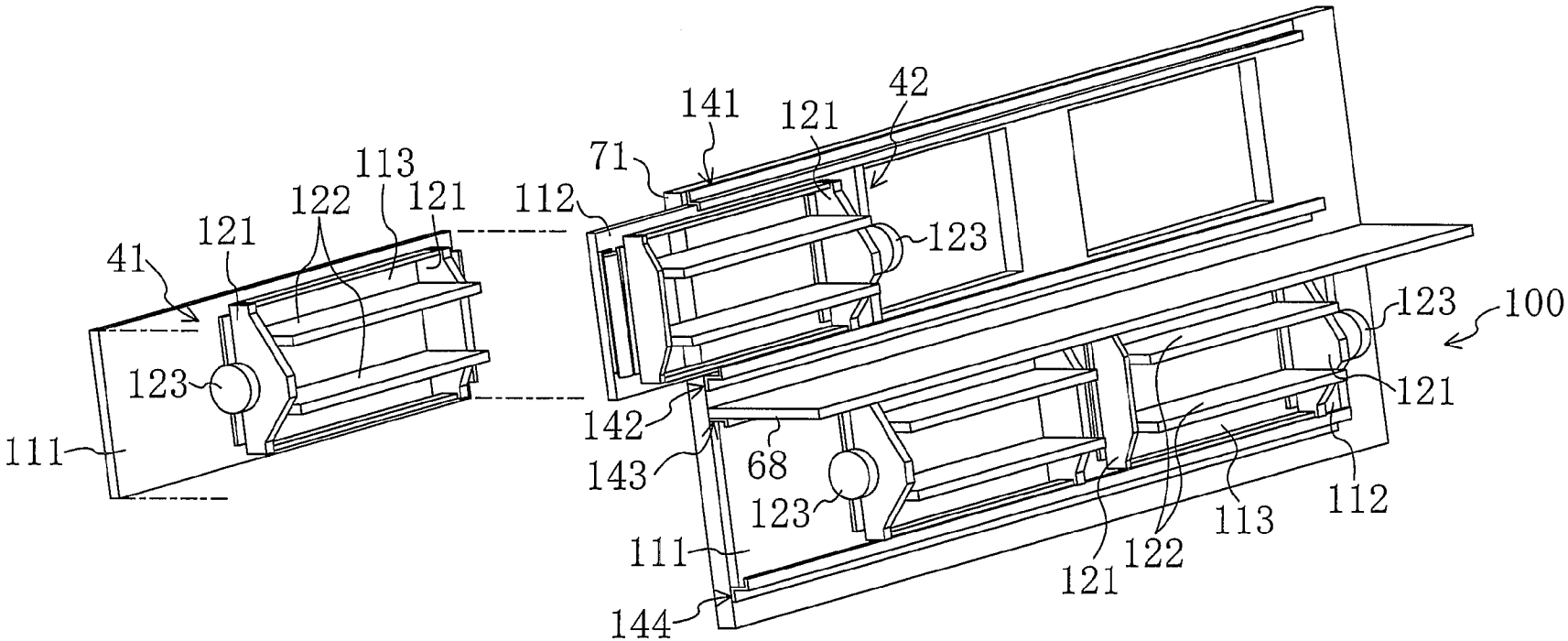
FIG. 18 is a perspective view illustrating how the damper unit is detached, in which the adjacent dampers are separated.

The first damper (41) as shown in FIG. 17 is no longer guided by the first and second rails (141, 142). Therefore, outside the casing (11), the flat protrusion (152) and the flat hook (162) are disengaged by sliding the first damper (41) toward the front panel (12) relative to the second damper (42). Thus, the first damper (41) and the second damper (42) of the damper unit (100) are separated from each other (see FIG. 18).

Figure 19:
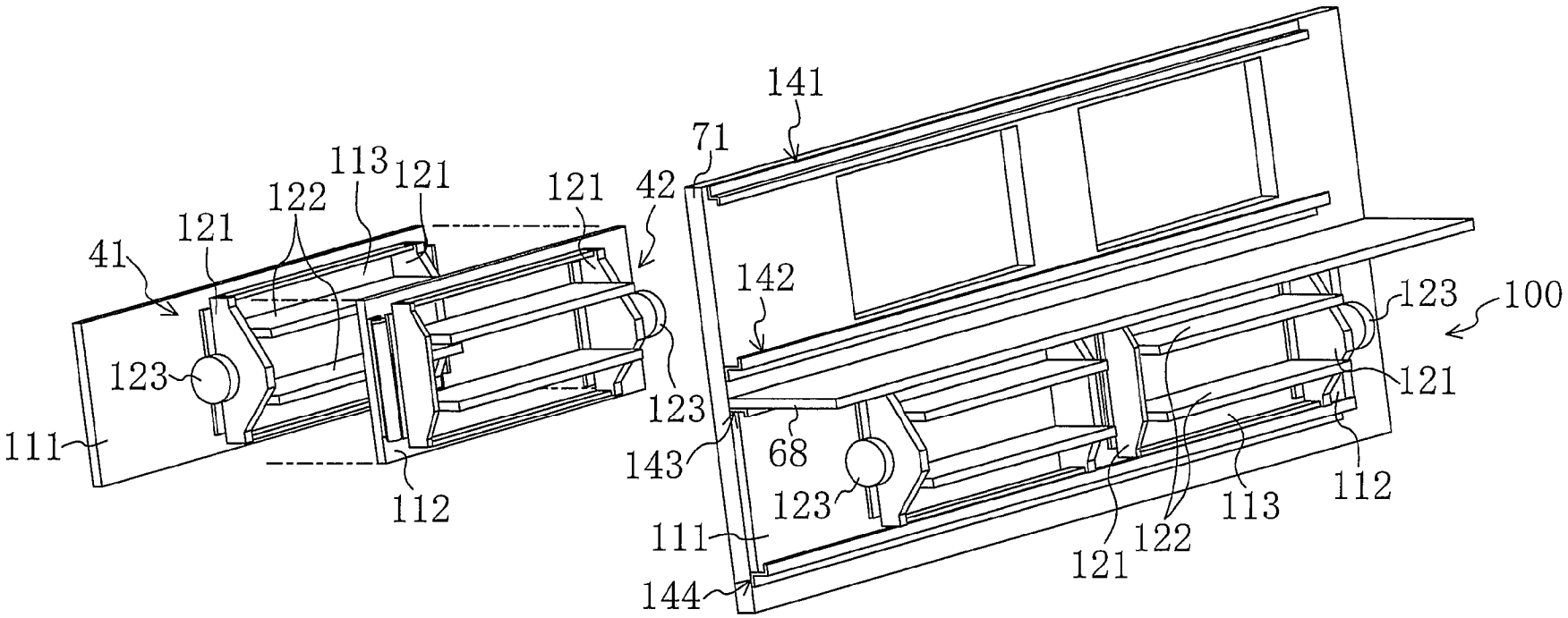
FIG. 19 is a perspective view illustrating how the damper unit is detached, in which the adjacent dampers are all detached from the casing.

After the first damper (41) is detached, the second damper (42) is further pulled out. Then, the second damper (42) is guided by the first and second rails (141, 142), and is drawn out of the casing (11) (see FIG. 19). In placing the damper unit (100) inside the casing (11), the above-described detachment is performed in a reverse manner. Specifically, the second damper (42) is first fitted in the first and second rails (141, 142) (see FIG. 18), and is pushed inside the casing (11). Then, the L-shaped plate (150) of the first damper (41) is engaged with the hook plate (160) of the second damper (42) to couple the first and second dampers (see FIG. 17), and the first damper (41) is fitted in the first and second rails (141, 142). Then, the first damper (41) is pushed inside the casing (11) together with the second damper (42), thereby placing the damper unit (100) to the original position in the casing (11) (see FIG. 8).

In this way, the dampers (41-48) of the humidity control apparatus (10) are suitably separated in attaching/detaching the damper units (100). This can reduce space required for attachment/detachment of the dampers (41-48). In the above-described example, only the first damper (41) and the second damper (42) on the upstream divider plate (71) are described. However, the attachment/detachment of the other dampers (43-48) can be performed in the same manner.

Advantages of Embodiment

In the above-described embodiment, a coupling member (152, 162) for separably coupling the adjacent dampers (41-48) is provided in the damper unit (100). This makes it possible to draw out or attach the adjacent dampers (41-48) coupled by the coupling member (152, 162) together. Therefore, for example, in comparison with the case where the dampers are detached/attached one by one, maintenance of the dampers (41-48) can be performed with improved efficiency. In the above-described embodiment, the front damper (41, 43, 45, 47) is separated while drawing the damper unit (100) out, thereby reducing space required to detach/attach the dampers (41-48). Thus, limitation on the installation location of the humidity control apparatus (10) is alleviated. Therefore, for example, in the case where the humidity control apparatus (10) is installed on the ceiling, sufficient space for maintenance of the dampers (41-48) can be ensured.

In the above-described embodiment, the rails (141-144) for guiding the dampers (41-48) are provided. This allows for easy detachment/attachment of the dampers (41-48), thereby improving the efficiency of maintenance With the provision of the flat protrusion (152) on one of the adjacent dampers (41-48), and the flat hook (162) on the other damper (41-48), the flat hook (162) is hooked on the flat protrusion (152) in drawing the damper unit (100) out, thereby reliably drawing out the dampers (41-48) together. Further, sliding the flat hook (162) in the direction orthogonal to the drawing direction relative to the flat protrusion (152) makes it possible to easily detach the flat protrusion (152) from the flat hook (162). This allows for easy separation of the dampers (41-48), thereby further improving the maintenance efficiency.

In the above-described embodiment, the damper unit (100) is drawn out in the direction of alignment of the dampers (41-48). With the dampers (41-48) configured to be separable, the length of the space required to draw out or attach the dampers (41-48) can effectively be reduced. Further, since the damper unit (100) can be drawn out in the same direction (from the first side panel (14)), the space for the maintenance of the dampers (41-48) can be concentrated on the same side of the casing (11). This allows for further reduction of the space for the maintenance of the dampers (41-48).

[Other Embodiment]

The above-described embodiment may be modified in the following manner.

In the above-described embodiment, the air is humidified by the humidity controller including the two adsorption heat exchangers (51, 52). However, the humidity controller is not limited to this structure. For example, an adsorption rotor carrying an adsorbent on a rotor plate, and a total heat exchanger for exchanging sensible heat and latent heat between the outdoor air and the room air can also be used.

In the refrigerant circuit (50) of the above-described embodiment, a supercritical refrigeration cycle may be performed in which the high pressure of the refrigeration cycle is higher than a critical pressure of the refrigerant. In this case, one of the first adsorptiton heat exchanger (51) and the second adsorptiton heat exchanger (52) functions as a gas cooler, and the other functions as an evaporator.

In the humidity control apparatus (10) of the above-described embodiment, cold water or hot water may be supplied to the first adsorptiton heat exchanger (51) and the second adsorptiton heat exchanger (52) to heat or cool the adsorbent.

The above-described embodiments are merely preferred embodiments in nature, and are not intended to limit the scope, applications and use of the invention.

Industrial Applicability

As described above, the present invention is useful for humidity control apparatuses including a plurality of dampers.

DESCRIPTION OF REFERENCE CHARACTERS

10 Humidity control apparatus
11 Casing
41-48 Damper
**41*a*-48*a*** Air flow port
100 Damper unit
141-144 Rail
152 Flat protrusion (coupling mechanism, engagement section)
162 Flat hook (coupling mechanism, engagement section)
170 Sealing member

The invention claimed is:

1. A humidity control apparatus comprising:

a casing in which air enters;

a plurality of humidity control chambers provided in the casing, and containing humidity controllers for controlling humidity of the air, respectively; and a damper unit capable of being installed in the casing, and removed from the casing when the damper unit is translated in a drawing direction out of the casing, wherein the damper unit includes;

a plurality of dampers for opening/closing a plurality of air flow ports communicating with the humidity control chambers when the damper unit is installed in the casing, and wherein the dampers are arranged adjacent to each other and aligned in the drawing direction when the damper unit is installed in the casing; and a coupling mechanism between adjacent dampers configured to couple adjacent dampers together when the damper unit is removed from the casing in the drawing direction, and the coupling mechanism is further configured to permit uncoupling and separation of the adjacent dampers after the damper unit is removed from the casing, whereby the uncoupling of the adjacent dampers is effected by the movement of the adjacent dampers relative to each other in a direction other than the drawing direction.

2. The humidity control apparatus of claim 1, wherein the casing includes a rail extending in a direction of drawing the damper unit to guide the damper unit.

3. The humidity control apparatus of claim 1 or 2, wherein the coupling mechanism includes a flat protrusion provided on a coupling end of one of the adjacent dampers to protrude orthogonally to the drawing direction, and a hook provided on a coupling end of the other damper, and is bent to cover a tip end of the flat protrusion.

4. The humidity control apparatus of claim 1, wherein the casing includes a divider plate in which the plurality of air flow ports communicating with the humidity control chambers are formed, and the damper unit is placed in the casing in such a manner that a gap formed between coupling ends of the adjacent dampers faces the divider plate.

5. The humidity control apparatus of claim 1, wherein the casing contains multiple ones of the damper unit arranged in such a manner that the dampers are aligned in the same direction.

6. The humidity control apparatus of claim 1, wherein the damper unit includes a sealing member for filling a gap formed between coupling ends of the adjacent dampers.

* * * * *